US006100462A

United States Patent [19]

Aoki

[11] Patent Number: 6,100,462

[45] Date of Patent: Aug. 8, 2000

[54] APPARATUS AND METHOD FOR GENERATING MELODY

[75] Inventor: Eiichiro Aoki, Hamamatsu, Japan

[73] Assignee: Yamaha Corporation, Japan

[21] Appl. No.: 09/322,450

[22] Filed: May 28, 1999

[30] Foreign Application Priority Data

May 29, 1998 [JP] Japan ..... 10-166302

[51] Int. Cl.[7] ..... G10H 1/38; G10H 7/00

[52] U.S. Cl. ..... 84/613; 84/637

[58] Field of Search ..... 84/613, 637, 650

[56] References Cited

U.S. PATENT DOCUMENTS

| | | | |
|---|---|---|---|
| 5,302,776 | 4/1994 | Jeon et al. | 84/613 |
| 5,403,967 | 4/1995 | Takano | 84/613 |
| 5,563,361 | 10/1996 | Kondo et al. | 84/613 X |
| 5,705,761 | 1/1998 | Minamitaka . | |

FOREIGN PATENT DOCUMENTS

| | | |
|---|---|---|
| 09050278A | 2/1997 | Japan . |
| 2615721 | 3/1997 | Japan . |

*Primary Examiner*—Jeffrey Donels
*Attorney, Agent, or Firm*—Rossi & Associates

[57] ABSTRACT

Key information designating a key for a tune to be composed and chord information designating chords for respective chord spans to constitute a chord progression for the tune are inputted to a melody generating apparatus. In the chord span to which a diatonic chord such as C major chord is designated, melody notes are generated using the scale notes of the inputted key, while in the chord span to which a nondiatonic chord such as DbM7 chord is designated, an available note scale is determined based on the key information and the chord information, and then melody notes are generated using the notes such as Ab Bb of the available note scale. As the notes which are neither the scale notes of the key nor the chord tones may be employed for a melody, the generated melody will have musical naturalness and fits the nondiatonic chords also.

24 Claims, 14 Drawing Sheets

C–IONIAN SCALE (C–MAJOR SCALE)

D–DORIAN SCALE

E –PHRYGIAN SCALE

F–LYDIAN SCALE

G–MIXOLYDIAN SCALE

A–AEOLIAN SCALE (A–NATURAL–MINOR SCALE)

B–LOCRIAN SCALE

Fig.2

| MAJOR CHORD | AVAILABLE NOTE SCALE |
|---|---|
| I−MAJOR CHORD | IONIAN SCALE |
| IV−MAJOR CHORD | LYDIAN SCALE |
| NONDIATONIC MAJOR CHORD<br>♭II−MAJOR CHORD<br>♭VI−MAJOR CHORD<br>♭VII−MAJOR CHORD | LYDIAN SCALE |

Fig.3

| DOMINANT 7TH CHORD | AVAILABLE NOTE SCALE |
|---|---|
| V7 CHORD | MIXOLYDIAN SCALE<br>ALTERED DOMINANT SCALE |
| IV7 CHORD | LYDIAN DOMINANT 7TH SCALE |
| II7 CHORD IN MAJOR KEY<br>IN MINOR KEY | LYDIAN DOMINANT 7TH SCALE<br>ALTERED DOMINANT 7TH SCALE |
| ♭VII7 CHORD | LYDIAN DOMINANT 7TH SCALE |
| ♭II7 CHORD | LYDIAN DOMINANT 7TH SCALE |
| VI7 CHORD | ALTERED DOMINANT 7TH SCALE |
| ♭VI7 CHORD | LYDIAN DOMINANT 7TH SCALE |
| ALTERED DOMINANT 7TH CHORD | ALTERED DOMINANT 7TH SCALE |

*Fig. 4*

| MAJOR KEY | MAJOR CHORD | AVAILABLE NOTE SCALE ( o =CHORD TONE ) |
|---|---|---|
| C | C | C—IONIAN SCALE |
| | F | F—LYDIAN SCALE |
| | $D^{\flat}M7$ | D♭—LYDIAN SCALE |
| | $B^{\flat}M7$ | B♭—LYDIAN SCALE |
| | ⋮ | ⋮ |
| E♭ | E♭ | E♭—IONIAN SCALE |
| | A♭ | A♭—LYDIAN SCALE |
| ⋮ | ⋮ | ⋮ |

*Fig. 5*
| MAJOR KEY | DOMINANT 7TH CHORD | AVAILABLE NOTE SCALE ( o =CHORD TONE ) |
|---|---|---|
| C | $G_7$ | G–MIXOLYDIAN SCALE 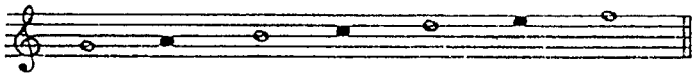 G–ALTERED–DOMINANT–7TH SCALE 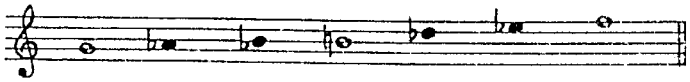 |
| | $D_7$ | D–LYDIAN–DOMINANT–7TH SCALE 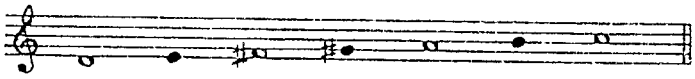 |
| | $B^b{}_7$ | B♭–LYDIAN–DOMINANT–7TH SCALE 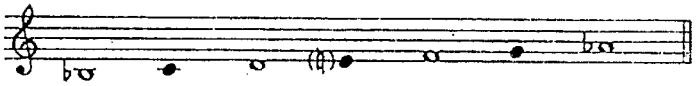 |
| | $D^b{}_7$ | D♭–LYDIAN–DOMINANT–7TH SCALE 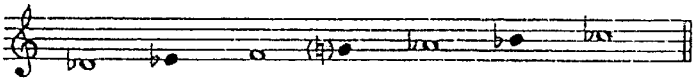 |
| | $A_7$ | A–ALTERED–DOMINANT–7TH SCALE 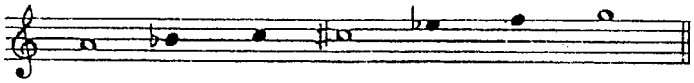 |
| | $A^b{}_7$ | A♭–LYDIAN–DOMINANT–7TH SCALE 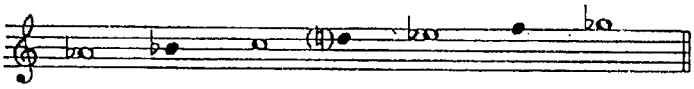 |
| | ⋮ | ⋮ |

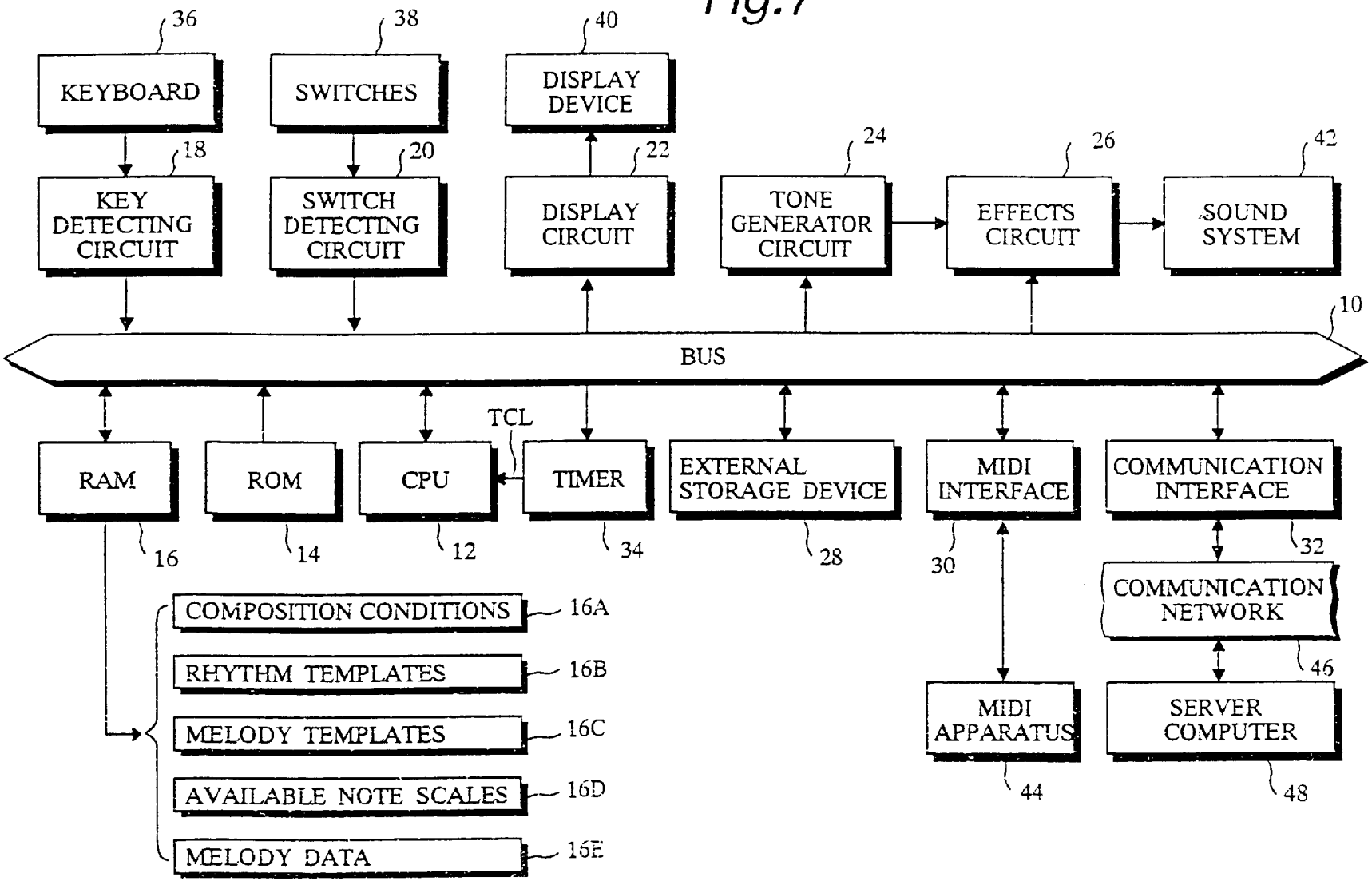
Fig.7
KEYBOARD
36
KEY DETECTING CIRCUIT
18
SWITCHES
38
SWITCH DETECTING CIRCUIT
20
DISPLAY DEVICE
40
DISPLAY CIRCUIT
22
TONE GENERATOR CIRCUIT
24
EFFECTS CIRCUIT
26
SOUND SYSTEM
42
BUS
10
RAM
16
ROM
14
CPU
12
TCL
TIMER
34
EXTERNAL STORAGE DEVICE
28
MIDI INTERFACE
30
COMMUNICATION INTERFACE
32
MIDI APPARATUS
44
COMMUNICATION NETWORK
46
SERVER COMPUTER
48
COMPOSITION CONDITIONS
16A
RHYTHM TEMPLATES
16B
MELODY TEMPLATES
16C
AVAILABLE NOTE SCALES
16D
MELODY DATA
16E

C : CHORD TONE
NC : NONCHORD TONE

APPARATUS AND METHOD FOR GENERATING MELODY

BACKGROUND OF THE INVENTION

1. Field of the Invention

The present invention relates to a melody generating apparatus and method, and a machine readable medium containing program instructions for realizing such an apparatus and a method, and more particularly to a melody generating apparatus and method in which, as key information and chord information are given, an available note scale is determined for a given chord in a given key and notes in the determined available note scale are sequentially employed to generate a melody, which will feel natural from a musical point of view including notes suitable for even nondiatonic chords. The invention is applicable in various kinds of electronic musical apparatuses such as an electronic musical instrument, an automatic music composing apparatus, and a computer-system-configured music composing apparatus.

2. Description of the Prior Art

Among various types of melody generating apparatuses known heretofore, there is a type of melody generating apparatus in which a key for an entire melody to be composed (i.e. generated) is designated or keys for respective fractions of a melody to be composed are designated, and a pitch template (a pitch variation pattern), a pitch for the first note in the phrase, a pitch for the last note in the phrase, etc are also designated for each of the phrases constructing a melody, and then notes are selectively employed in sequence for each phrase from among the scale notes of the key for the phrase and in such a fashion that the selected notes exhibit a melody motion which meets the designated pitch variation pattern. Such an example is disclosed in unexamined Japanese patent publication No. Hei 9-50287.

Another known type of melody generating apparatus is the one in which a chord progression for a melody to be composed is given and then a key is determined for each chord span based on the chord designated for that span and the chord(s) of the preceding span(s), and notes are selectively picked up from the musical scale of the determined key to be aligned in a time sequence, thereby to generate a melody. Such an example is disclosed in issued Japanese patent publication No. 2,615,721.

With the apparatus of the above first type, i.e. a key designation type, upon designation of a key or keys, there will be generated a melody which matches the designated key. However, a melody which matches a chord or chords arbitrarily designated by the operator may not always be generated.

On the other hand, with the apparatus of the above second type, upon designation of desired chords, there will be generated a melody which matches such designated chords. The melody, however, is constructed using only the scale notes of the key as detected from the designated chord, and therefore a melody produced based on a diatonic chord (a chord constituted by the notes included in the scale notes of the key) will be good and agreeable with the chord, but a melody generated based on a nondiatonic chord (a chord having at least a note which is not included in the scale of the key in addition to a note or notes in the scale of the key) will not be so well mingled with the chord, and consequently it will be hard to generate a natural pleasing melody which is adequate for the chord.

SUMMARY OF THE INVENTION

It is, therefore, a primary object of the present invention to provide a melody generating apparatus and method and a machine readable medium containing a program therefor capable of generating a melody which will adequate for and agree with nondiatonic chords, too, to exhibit naturalness in the musical feeling.

According to the present invention, the object is accomplished by providing a melody generating apparatus which comprises: an input device which inputs key information designating a key and chord information designating chords for a melody to be generated; an available note scale providing device which provides available note scales based on the inputted key information and the chord information; a note targeting device which sequentially targets notes to be aligned in a melody; a note selecting device which selects for each targeted note a note from among the provided available note scale at random; and a melody constructing device which sequentially aligns the selected notes.

According to an aspect of the present invention, a melody generating apparatus comprises: a note set providing device which provides at least one available note scale as a first set of notes based on the inputted key information and chord information, and provides chord tones which constitute the chord defined by the inputted chord information as a second set of notes; a note category assigning device which classifies each of the notes to be targeted by assigning to each of the notes an indication of either a primary note or a secondary note; and a note selecting device which selects a note from among the chord tones for the target note where the target note is a primary note, and selects a note from among the available note scale where the target note is a secondary note.

According to another aspect of the present invention, a melody generating apparatus comprises: a note set providing device which provides at least one available note scale as a first set of notes based on the inputted key information and the chord information, and provides scale notes which constitute the scale defined by the inputted key information as a second set of notes; a chord category judging device which judges whether the chord defined by the inputted chord information is a diatonic chord or a nondiatonic chord; and a note selecting device which selects a note from among the scale notes for the target note where the chord is a diatonic chord, and selects a note from among the available note scale where the chord is a nondiatonic chord.

According to a further aspect of the present invention, a melody generating apparatus comprises: a note set providing device which provides at least one available note scale based on the inputted key information and the chord information, and provides a first set of notes consisting of those notes in the available note scale which are the notes included in the designated chord and a second set of notes consisting of those notes in the available note scale which are the notes not included in the designated chord; a note category assigning device which classifies each of the notes to be targeted by assigning to each of the notes an indication of either a chord tone or a nonchord tone; and a note selecting device which selects a note that belongs to the first set of notes where the target note is assigned with the chord tone indication, and selects a note that belongs to the second set of notes where the target note is assigned with the nonchord tone indication.

According to the present invention, the object is further accomplished by providing a method for generating a melody which comprises the steps of: inputting key information which designates a key and chord information which designates chords for a melody to be generated; providing available note scales based on the inputted key information and the chord information; targeting a note at a time position among a succession of time positions defining a rhythmic progression of the melody to be generated, the step of targeting occurring in a sequence; selecting for each targeted note a note pitch from among the provided available note scale; and aligning the selected note pitches in the targeted sequence.

According to a still further aspect of the present invention, a method for generating a melody comprises: a step of assigning to each of the notes to be targeted an indication of either a primary note or a secondary note; a step of providing sets of note pitches which provides at least one available note scale as a first set of note pitches based on the inputted key information and chord information, and provides chord tones which constitute the chord defined by the inputted chord information as a second set of note pitches; and a step of selecting a note pitch which selects a note from among the chord tones for the target note where the target note is a primary note, and selects a note from among the available note scale where the target note is a secondary note.

According to a still further aspect of the present invention, a method for generating a melody comprises: a step of judging whether the chord defined by the inputted chord information is a diatonic chord or a nondiatonic chord; a step of providing sets of note pitches which provides at least one available note scale as a first set of note pitches based on the inputted key information and chord information, and provides note pitches which constitute the scale defined by the inputted key information as a second set of note pitches; and a step of selecting a note pitch which selects a note pitch from among the second set of note pitches for the target note where the chord is a diatonic chord, and selects a note pitch from among the first set of note pitches for the target note where the chord is a nondiatonic chord.

According to a still further aspect of the present invention, a method for generating a melody comprises: a step of assigning to each of the notes to be targeted an indication of either a chord tone or a nonchord tone; a step of providing sets of note pitches which provides at least one available note scale based on the inputted key information and chord information, and provides a first set of note pitches consisting of those in the available note scale which are the note pitches included in the designated chord and a second set of note pitches consisting of those in the available note scale which are the note pitches not included in the designated chord; and a step of selecting a note pitch which selects a note pitch that belongs to the first set of note pitches where the target note is assigned with the chord tone indication, and selects a note pitch that belongs to the second set of note pitches where the target note is assigned with the nonchord tone indication.

According to the present invention, the object is still further accomplished by providing a machine readable medium for use in an apparatus for generating a melody, the apparatus being of a data processing type comprising a computer, the medium containing program instructions executable by the computer for executing: a process of inputting key information which designates a key and chord information which designates chords for a melody to be generated; a process of providing available note scales based on the inputted key information and the chord information; a process of targeting a note at a time position among a succession of time positions defining a rhythmic progression of the melody to be generated, the process of targeting occurring in a sequence; a process of selecting for each targeted note a note pitch from among the provided available note scale; and a process of aligning the selected note pitches in the above sequence.

According to a still further aspect of the present invention, the program may further include instructions to execute a process of assigning to each of the notes to be targeted an indication of either a primary note or a secondary note so that the process of selecting a note pitch should select a note from among the chord tones for the target note where the target note is a primary note, and select a note from among the available note scale where the target note is a secondary note.

According to a still further aspect of the present invention, the program may further include instructions to execute a process of judging whether the chord defined by the inputted chord information is a diatonic chord or a nondiatonic chord so that the process of selecting a note pitch should select for the target note a note pitch from among the note pitches which constitute the scale defined by the inputted key information where the chord is a diatonic chord, and select for the target note a note pitch from among the note pitches included in the available note scale as determined based on the inputted key information and chord information where the chord is a nondiatonic chord.

According to the present invention, the key information and the chord information may be inputted manually by the user of the apparatus using a musical keyboard, and also may be supplied as data signals from other MIDI devices or storage medium reading devices.

According to the present invention, therefore, a melody having musical naturalness when contrasted with coexisting chords will be generated.

BRIEF DESCRIPTION OF THE DRAWINGS

For a better understanding of the present invention, and to show how the same may be practiced and will work, reference will now be made, by way of example, to the accompanying drawings, in which:

FIG. 2 is a table showing available note scales for various major chords;

FIG. 3 is a table showing available note scales for various dominant 7th chords;

FIG. 4 is a table showing an available note scale for each of several major chords in different keys;

FIG. 5 is a table showing an available note scale for each of several dominant 7th chords in the key of C-major;

FIG. 7 is a block diagram showing an example of an electronic musical instrument embodying a melody generating apparatus according to the present invention;

DESCRIPTION OF THE PREFERRED EMBODIMENTS

Figure 1A:
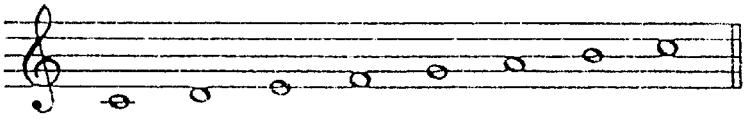
FIGS. 1*a*, 1*b*, 1*c*, 1*d*, 1*e*, 1*f* and 1*g* are staves respectively showing respective ones of seven diatonic musical scales.
Figure 1B:
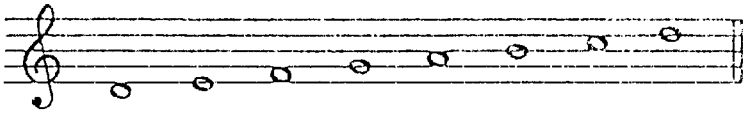
Figure 1C:
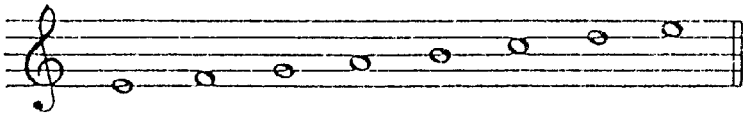
Figure 1D:
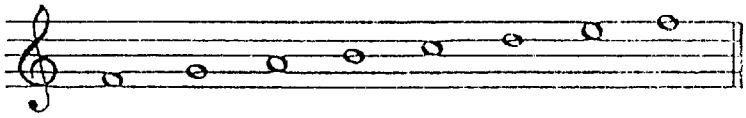
Figure 1E:
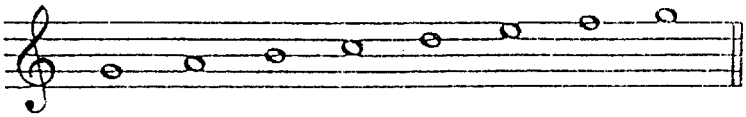
Figure 1F:
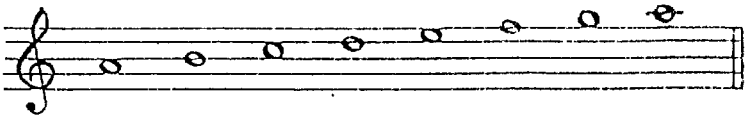
Figure 1G:
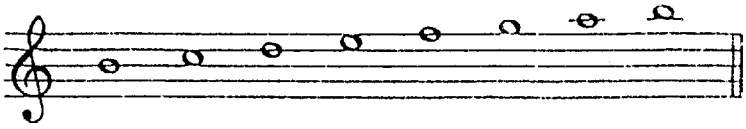

In the present invention, key information representing a desired key for a melody to be composed and chord information representing desired chords for the respective chord spans are provided to start with, and then an available note scale is determined or established for each chord span based on the designated key and the designated chord of such each span, for generating a melody.

Chords are generally categorized as diatonic chords and nondiatonic chords. The diatonic chords are chords constituted by the notes in each diatonic scale of, for example, seven kinds of diatonic scales as shown in FIGS. 1*a*–1*g*, while nondiatonic chords are chords constituted by including an alteration or alterations, i.e. a note or notes not existing in the diatonic scale.

An available note scale is a musical scale inherently determined for each chord in a given key and starts with the chord root note and includes notes which correspond to the chord tones of such each chord, and will be hereinafter occasionally referred to as "AVNS" for the sake of brevity. For example, with respect to the major chords, the available note scales are established as shown in the table of FIG. 2, and with respect to the dominant 7th chords, the available note scales are determined as shown in the table of FIG. 3. More specifically, the available note scale for a I-major chord (a major chord whose root note is a first degree note, i.e. a key note, in the scale of the given key) is an Ionian scale in the given key as seen from FIG. 2, and the available note scale for a IV7 chord (a dominant 7th chord whose root note is a fourth degree note in the scale of the given key) is a Lydian dominant 7th scale in the given key as seen from FIG. 3.

FIGS. 4 and 5 show specific examples of available note scales. Shown in FIG. 4 are available note scales respectively determined for the major chords of C, F, DbM7 (D flat major seventh) and BbM7 in the key of C, and available note scales respectively determined for the major chords of Eb and Ab. Similarly, shown in FIG. 5 are available note scales respectively determined for the dominant 7th chords of G7, D7, Bb7, Db7, A7 and Ab7. In these figures, the whole note symbols (hollow circles) indicate chord tones (chord constituting tones) and the solid circles indicate nonchord tones. It should be understood herein that the musical flat sign ( ) will be represented by an alphabet character "b" in the non-superscripted level, where necessary for the sake of simplicity, as long as so understandable from the context. The numeral "7" and the character "M" will not be subscripted, either.

By providing an available note scale memory indicating respectively corresponding available note scales to be determined for various chords including diatonic chords and nondiatonic chords in each key in the fashion shown in FIGS. 4 and 5, it will be convenient for easily determining an available note scale based on the given key and chord information. According to the present invention, notes are selectively employed from among the determined available note scales and aligned into a melody to generate melody data representing the created melody.

Figure 6:
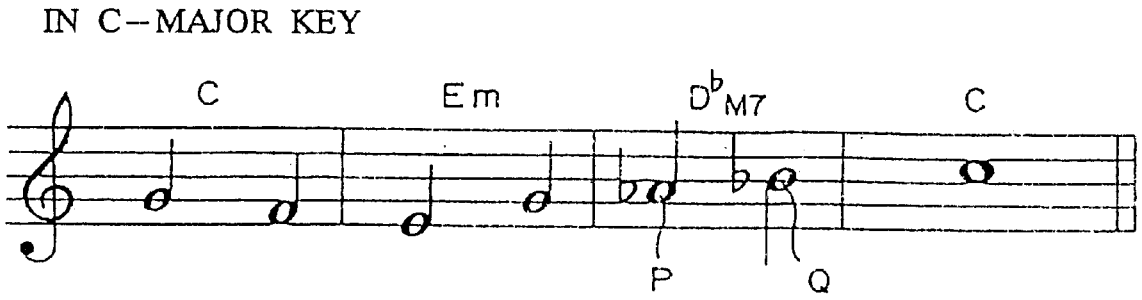
FIG. 6 is a staff showing an example of a generated melody in the key of C-major according to the present invention.

FIG. 6 shows a generated melody in the key of C-major as an example in this invention. In the first chord span for which a diatonic chord "C major" is designated, two notes C and F are selected from among the notes in the C Ionian scale shown in FIG. 4 and employed for constructing a melody for the span. In the second chord span for which a diatonic chord "E minor" is designated, two notes E and G are selected from among the notes in the E Aeolian scale (not shown in FIGS. 4 and 5) and employed for constructing a melody for the span. In the third chord span for which a nondiatonic chord "DbM7" is designated, two notes A flat and B flat are selected from among the Db Lydian scale shown in FIG. 4 and employed for constructing a melody for the span.

Table 1 below compares the notes in the C major scale and the notes in the Db Lydian scale.

TABLE 1

| | | | | | | | |
|---|---|---|---|---|---|---|---|
| Notes in C-Major Scale | C | D | E | F | G | A | B |
| Notes in Db-Lydian Scale | C | Db | Eb | F | G | Ab | Bb |

According to the present invention, as will be understood from the above table, the nonscale notes Ab and Bb (shown as P and Q, respectively, in FIG. 6) of the key of C and a nonchord tone Bb (shown as Q in FIG. 6) of the chord of DbM7 in the available note scale can be selected and employed for melody construction, which permits the generation of a naturally-felt melody getting along well also with nondiatonic chords.

In the example of FIG. 6, the note P (Ab) can be selected from among the chord tones of DbM7 where the note selection rule is to select from among the chord tones (chord constituting notes) as are determined from the chord name and thus an available note scale may not be prepared for this note selection. But, with respect to the note Q (Bb), it is not a chord tone of DbM7 chord, and therefore, an available note scale has to be provided for the DbM7 chord in order to select this note Q (Bb). As the present invention determines an available note scale based on the inputted key and chord and selects notes from among such an available note scale to construct a melody, such a nonchord tone as the above mentioned note Q (Bb) is selectable from among the available note scale, which will lead to an enhancement of the character of a nondiatonic chord.

FIG. 7 shows an example of a circuit structure of an electronic musical instrument embodying a melody generating apparatus according to the present invention to implement the melody generation. This electronic musical instrument is of a type in which the melody generation, the musical tone generation, etc. are controlled and executed by means of a small computer such as a personal computer.

In this computer associated system, connected to a bus 10 are a CPU (central processing unit) 12, a ROM (read only memory) 14, a RAM (random access memory) 16, a key detecting circuit 18, a switch detecting circuit 20, a display circuit 22, a tone generator circuit 24, an effects circuit 26, an external storage device 28, a MIDI interface 30, a communication interface 32 and a timer 34. The CPU 12 is to executes various processes for melody generation according to the programs stored in the ROM 14, which processes will be described hereinafter with reference to FIGS. 9–16. The ROM 14 also stores available note scale tables. The available note scale tables indicate available note scales each in the form of a set of member notes constituting the scale and in correspondence to each of the various chords to be handled including diatonic chords and nondiatonic chords for each of the keys as shown in FIGS. 4 and 5. The RAM 16 includes various subdivisions to be used for the respective processes by the CPU 12. Such subdivisions are a memory area 16A for storing composition conditions, a memory area 16B for storing rhythm templates, a memory area 16C for storing melody templates, a memory area 16D for storing available note scales and a memory area 16E for melody data of a generated melody.

The key detectin g circuit 18 detects actuations of the keys in the keyboard 36 such as a musical keyboard. The switch detecting circuit 20 detects actuations of the switches 38. Switches 38 comprises, for example, key switches in an alphanumeric keyboard for inputting alphabetic characters and numeric characters. Th e display circuit 22 controls displaying operations of the display device 40 to permit various visual indications on the video screen.

The tone generator circuit 24 comprises a plurality of musical tone generating channels for generating various demanded tones. The type or fashion of tone generation may be a wave memory type, an FM synthesis type, a physical model type, a harmonics combination type, a formant filtering type, an analog synthesizer type including VCOs , VCFs and VCAS, or any other type available in the art. The tone generator circuit 24 is not limited to a hardware structure exclusively functioning as a tone generator, but m ay be a combination of a DSP (digital signal processor) and a microprogram or a combination of a CPU and a software thereby functioning as a tone generator. The plural tone generating channels may be formed by plural separate (individual) hardware circuits or by a single hardware circuit under a time division multiplexed use. The effects circuit 26 is to impart sound effects such as a chorus effect and a reverberation effect to the tone signals from the tone generator circuit 24. The effect-imparted tone signals from the effects circuit 26 are supplied to a sound system 42 to be converted into audible sounds in the atmosphere.

Figure 8A:
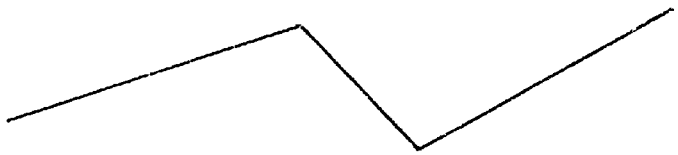
FIGS. 8*a* and 8*b* are charts respectively showing examples of a melody pattern and a rhythm pattern.
Figure 8B:
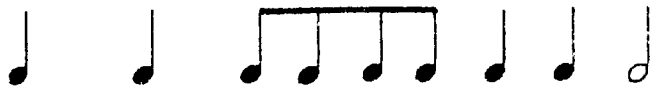

The external storage device 28 may be detachably provided with one or plural types of storage media such as a hard disk (HD), a floppy disk (FD), a compact disk (CD), a digital versatile disk (DVD) and a magneto-optical disk (MO). When the external storage device 28 is equipped with such a storage medium, the data on the medium can be transferred to the RAM 16. Where the equipped storage medium is of a writable type like an HD and an FD, the data in the RAM 16 can be transferred to such a storage medium. A storage medium to be equipped to the external storage device carries a data base comprising data of a number of rhythm templates and a number of melody templates, each template being of a size of, for example, a musical phrase. FIG. 8*a* shows an example of a melody pattern in terms of pitch variation as represented by a melody template. FIG. 8 shows an example of a rhythm pattern in terms of sounding timing as represented by a rhythm template. The melody template and the rhythm template may be factory-set or may be arbitrarily composed and registered by the user. In place of the external storage device 28, the data base of the rhythm templates and of the melody templates may be stored in the ROM 14 or the RAM 16. The programs may be stored in any of the above-mentioned storage media such as HD, FD, CD, DVD and MO to be used in the external storage device 28 in place of the ROM 14. In such a case, the programs stored on the storage medium will be transferred from the external storage device 28 to the RAM 16 for the operation of the system so that the CPU should execute the program instructions being supplied from the RAM 16. This type of configuration will be preferable for easily realizing any addition to the programs or up-grading of the program versions.

The MIDI interface 30 is provided to transmit and receive the music performance information to and from another MIDI apparatus 44 such as an automatic performance or accompaniment apparatus. The communication interface 32 is provided to conduct data communication with a server computer 48 via a communication network 46 such as a LAN (local area network), Internet and a telephone line. Thus, the programs and the data necessary for the implementation of the present invention can be downloaded from the server computer 48 to the RAM 16 or to the external storage device 28 via the communication network 46 and the communication interface 32 according to a download demand.

The timer 34 generates a tempo clock signal TCL having a period determined by given tempo data, and supplies the tempo clock signal TCL to the CPU 12 as interrupt requests. The CPU 12 starts an interrup t operation upon receipt of each clock pulse of the tempo clock signal TCL. The apparatus thus conducts an automatic performa nce of t he generated melody based on melody data stored in the subdivision 16E of the RAM 16.

Every time a key is depressed in the keyboard 36 of the above-mentioned electronic musical instrument, the CPU 12 supplies a pitch indicating signal and a tone generation instruction signal corresponding to the depressed key to the tone generator circuit 24. The tone generator circuit 24 in turn generates a tone signal having a pitch corresponding to the depressed key in accordance With the supplied pitch indication signal and tone generation instruction signal. Thus, the apparatus is capable of pro ducing manual performance tones.

Figure 9:
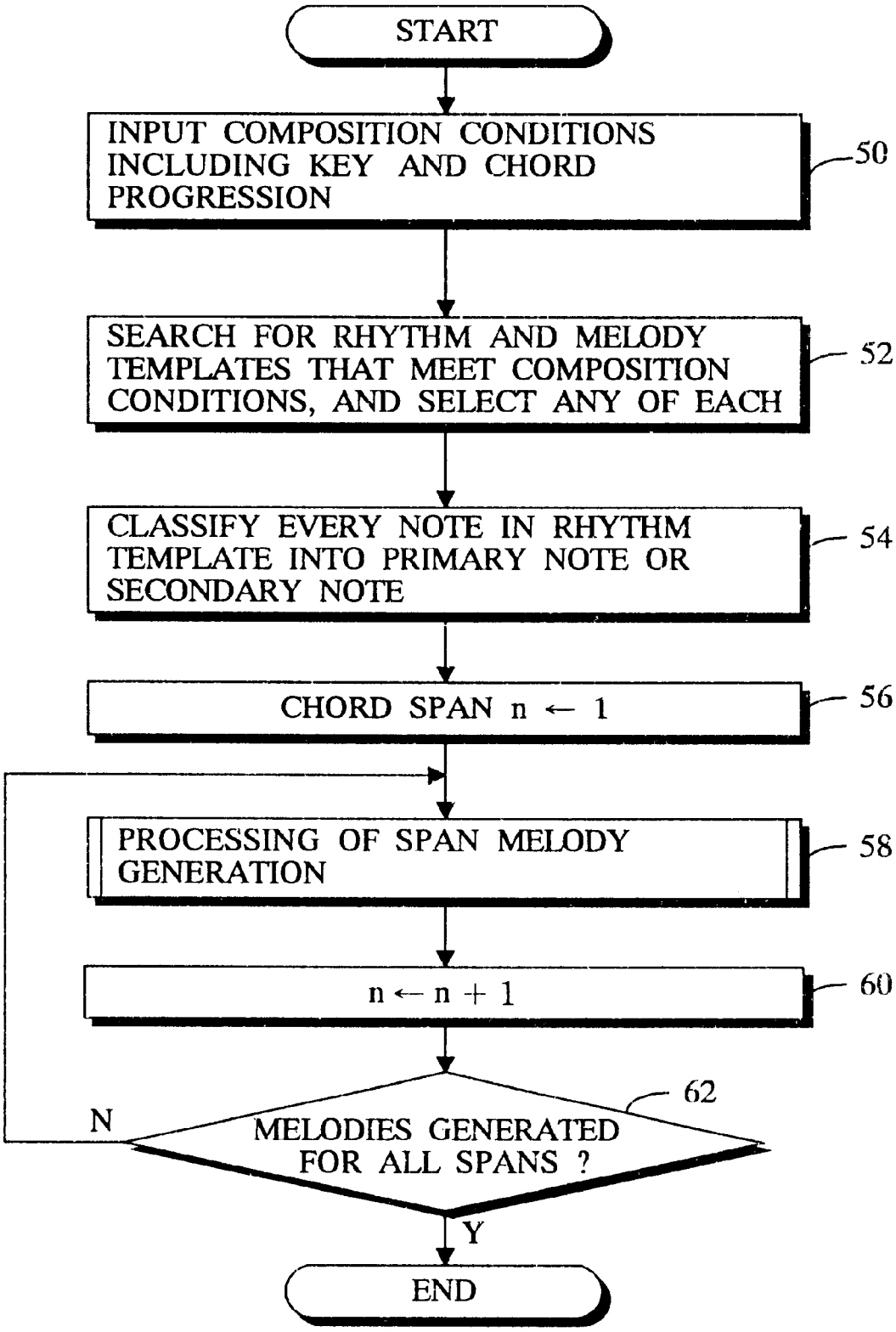
FIG. 9 is a flow chart of a program routine of an example of melody generation processing.

FIG. 9 shows a program routine of an example of the melody generation processing according to the present invention. At a step 50, the operator or user of the melody generating apparatus inputs composition conditions including a key a nd a chord progression for a melody to be generated. More particularly, the user manipulates the keyboards 36 and the switches 38 to designate a key for the melody, a chord progression (i.e. a sequence of chords, each chord constituting a chord span) to be employed in the melody, a sentence construction in terms of symbols (like A, B, C, C', . . . ) representing degrees of resemblance of melody pieces, the number of phrases in each sentence, the number of measures in each phrase, the number of syllables of words (lyric) or the number of notes, the type of cadence (half-cadence or perfect cadence), the melody appearance (melodic or rhythmic), the note range (compass), the existence/nonexistence of syncopation, etc. The inputted composition condition data are stored in the subdivision memory area 16A as indicated in FIG. 7.

Next, a step 52 searches, with respect to each phrase, the above data base for a rhythm template and a melody template which satisfy the inputted composition conditions as stored in the memory subdivision 16A. Usually, a plurality of rhythm templates and a plurality of melody templates will be picked up for each phrase through the search. Therefore, a selection step will be necessary to select any one from among the plurality of rhythm templates for each phrase and to select any one from among the plurality of melody templates for each phrase. The selection process may be conducted based on the user's manual operations. For instance, while exhibiting the plural templates of selection objects are being displayed on the screen of the display device 40, the user will designate any desired one from among the displayed templates by means of the actuation of the intended one among the switches 38. Another fashion may be that the apparatus selects a template automatically according to some previously provided conditions irrespective of the user's will. Through the selection processing, a series (sequence) of selected rhythm templates are stored in the memory area 16B and a series (sequence) of selected melody template are stored in the memory area 16C. After the step 52, the process proceeds to a step 54.

The step 54 is to classify all notes in the rhythm templates stored in the memory area 16B into primary notes and secondary notes, that is, to assign to every note a mark of intended importance in the rhythm pattern, by writing "primary note" mark data in the memory area 16B with respect to each of the notes to which primary importance is assigned. The primary notes in this context mean, for example, strong beat (down beat) notes, accented notes, notes having a long duration, other important notes such as the top note in the nondiatonic chord span. The secondary notes mean other notes having less importance than the primary notes. After the step 54, the process moves forward to a step 56.

In the step 56, a numeral "1" is set in the chord span number register "n". A predetermined area in the RAM 16 is allotted for this register n. Following the step 56, a step 58 performs processing of generating a span melody for the chord span having a number indicated by the register n. csehen the process comes to the step 58 for the first time after the step 56 has set n=1, the processing of generating a span melody for the chord span numbered "1" (i.e. first chord span) takes place, and the melody data representing the generated melody for the first chord span is stored in the memory area 16E. Specific examples of span melody generation processing will be described later with reference to FIGS. 10–16. In th is context, the term "to generate a melody" means "to generate data signals representing notes to constitute a melody" and not "to generate audible sound wave signals forming a melody, as long as so understandable.

Following the step 58, a step 60 increases the value of the register n by "1" to indicate the next chord span for processing. Next, the step 62 judges whether the melody generation processing has been completed for all the chord spans (chord sections). When the process comes to the step 60 for the first time after the step 56, the value "n" becomes "2", which means not all the spans are over in generating span melodies. Thus, the judgment at the step 62 proves negative (N) and the process goes back to the step 58. The step 58 performs span melody generation processing for the chord span numbered "2" and the melody data representing the generated melody for the second chord span is written in the memory area 16E. And then, the step 60 makes n=3 and the step 62 judges whether the melody generation processing is over for all the chord spans. If the result of the judgment turns out negative (N), the process moves back to the step 58 to repeat the processing through the steps 58–62 as described above. When the span melody generation processing is over and melodies have been generated for all the chord spans, the judgment at the step 62 results affirmative (Y) and the melody generation processing comes to an end. Thus the memory area 16E stores melody data for all the spans of a piece of music (tune).

For the melody generation processing of FIG. 9, the data base may include a number of rhythm templates and a number of melody templates each for each musical sentence (in the unit of sentence) so that the step 52 may search for and select a rhythm template and a melody template for each sentence. The data base may include a number of rhythm templates and a number of melody templates each for each tune (in the unit of tune) so that the step 52 may search and select a rhythm template and a melody template for each tune.

Figure 10:
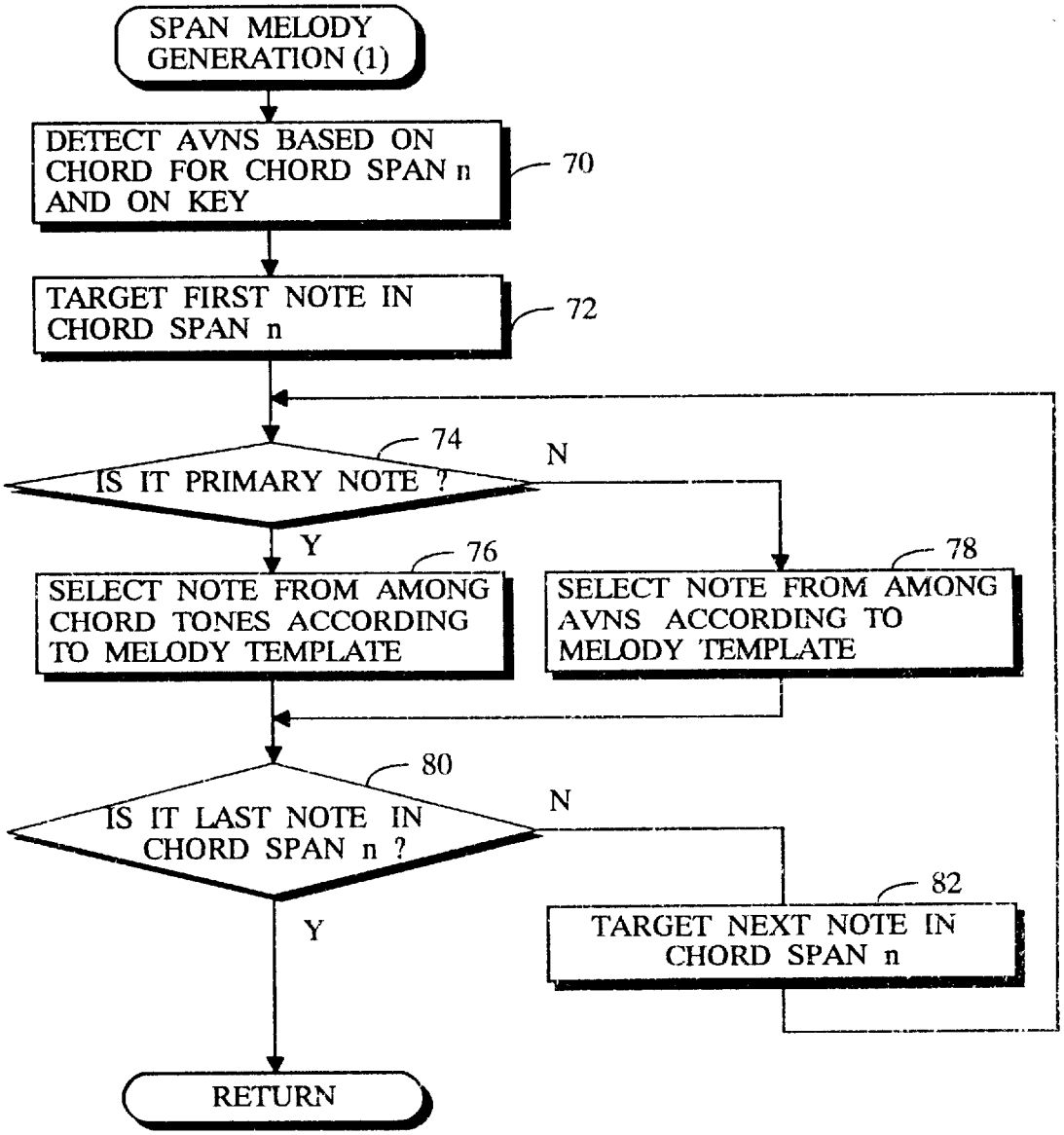
FIG. 10 is a flow chart of a subroutine showing a first example of the processing of span melody generation.

FIG. 10 shows a first example of the subroutine for generating span melodies as conducted at the step 58 of FIG. 9 above. A step 70 is to detect or determine an available note scale (AVNS) for a designated chord span. The detection of the available note scale is per formed by referring to the inputted key data and the inputted chord data for the chord span "n" (i.e. a chord span having a reister number of "n") and referring to the AVNS table in the ROM 14 based on the above key data and the above chord data. As an example, where the key data represents the key o f C major and the chord data represents the chord of D flat major 7th (DbM7), the AVNS determined from the table will be D flat Lydian scale as seen from FIG. 4. In the AVNS detection process, data representing the notes constituting the detected AVNS are written into the memory area 16D of FIG. 7. For example, where the Db Lydian scale is determined as the AVNS for the designated span, the data representing the notes of the Db Lydian scale, namely the notes Db, Eb, F, G, Ab, Bb and C are written in the memory area 16D. After the step 70 comes a step 72. As long as understandable from the context, term "note" is simply used herein to mean "pitch data signal representing a note", and not an "audible sound wave signal".

In the step 72, the first note in the designated chord span "n" is targeted (nominated or picked up for processing). Namely, the reference is made to the first note of the chord span "n" in the searched rhythm template in the memory area 16B. Then a step 74 judges whether the targeted note is a primary note. As the primary note marks have been given to the notes classified as primary notes at the step 54 of FIG. 9, the judgment is conducted by detecting the existence of such primary note mark data with the targeted note.

Where the judgment result at the step 74 is affirmative (Y), the targeted note is a primary note, and the process moves forward to a step 76. The step 76 is to select a note from among the chord tones according to the searched melody template in the memory area 16C. The chord tones here are the notes constituting a chord (for example C major chord) represented by the inputted chord data for the chord span "n", and may easily be obtained by using, for example, a conversion table which gives the chord tones from the chord data. As an example, the note P in FIG. 6 is the one selected from among the chord tones of the DbM7 chord.

Where the judgment result at the step 74 is negative (N), the targeted note is a secondary note, and the process moves forward to a step 78. The step 78 selects a note from among the AVNS constituting notes according to the searched melody template in the memory area 16C. The AVNS notes here are the notes indicated by the data in the storage subdivision 16D of FIG. 7. As an example, the note Q in FIG. 6 is the one selected from among the notes in the Db Lydian scale as the available note scale.

In selecting a note according to the searched melody template at the step 76 or 78, a note is determined so that the pitch change from the preceding note should be identical with or similar to the pitch change as indicated by the melody template. The selected note is employed as the melody note, and the data representing this melody note is written in the memory area 16E. When either of the steps 76 and 78 is over, the process goes to a step 80 to judge whether the target note is the last note in the chord span "n". When the process comes to the step 80 for the first time after the step 72 has targeted the first note in the chord span "n", and where the first note is not the last note in the span, the judgment at the step 80 turns out negative (N) and the process moves to a step 82.

The step 82 targets the next note in the chord span "n". Namely, the next note of the chord span "n" is referred to in the searched rhythm template in the memory area 16B. And then, the process goes back to the step 74 to repeat the steps 74–80 as described above. Thereafter, the processing through the steps 74–82 is repeated until the process at the step 76 or 78 is over with respect to the last note in the chord span "n". When the process at the step 76 or 78 is completed for the last note in the chord span "n", the step 80 judges affirmative (Y) and the process returns to the step 60 in FIG. 9. At this time, the melody data representing the note pitches for all of the rhythm notes (notes in the rhythm pattern) as indicated by the rhythm template for the chord span "n" are stored in the memory area 16E.

According to the span melody generation processing of FIG. 10, the notes are classified into primary notes and secondary notes, and the melody notes are selected from the inputted chord constituting notes for the primary notes and from the detected AVNS notes for the secondary notes. Thus, the generated melody will fit the chords well both in the case of diatonic chords and the case of nondiatonic chords, and will give a natural feeling as compared with diatonic chords and nondiatonic chords.

Figure 11:
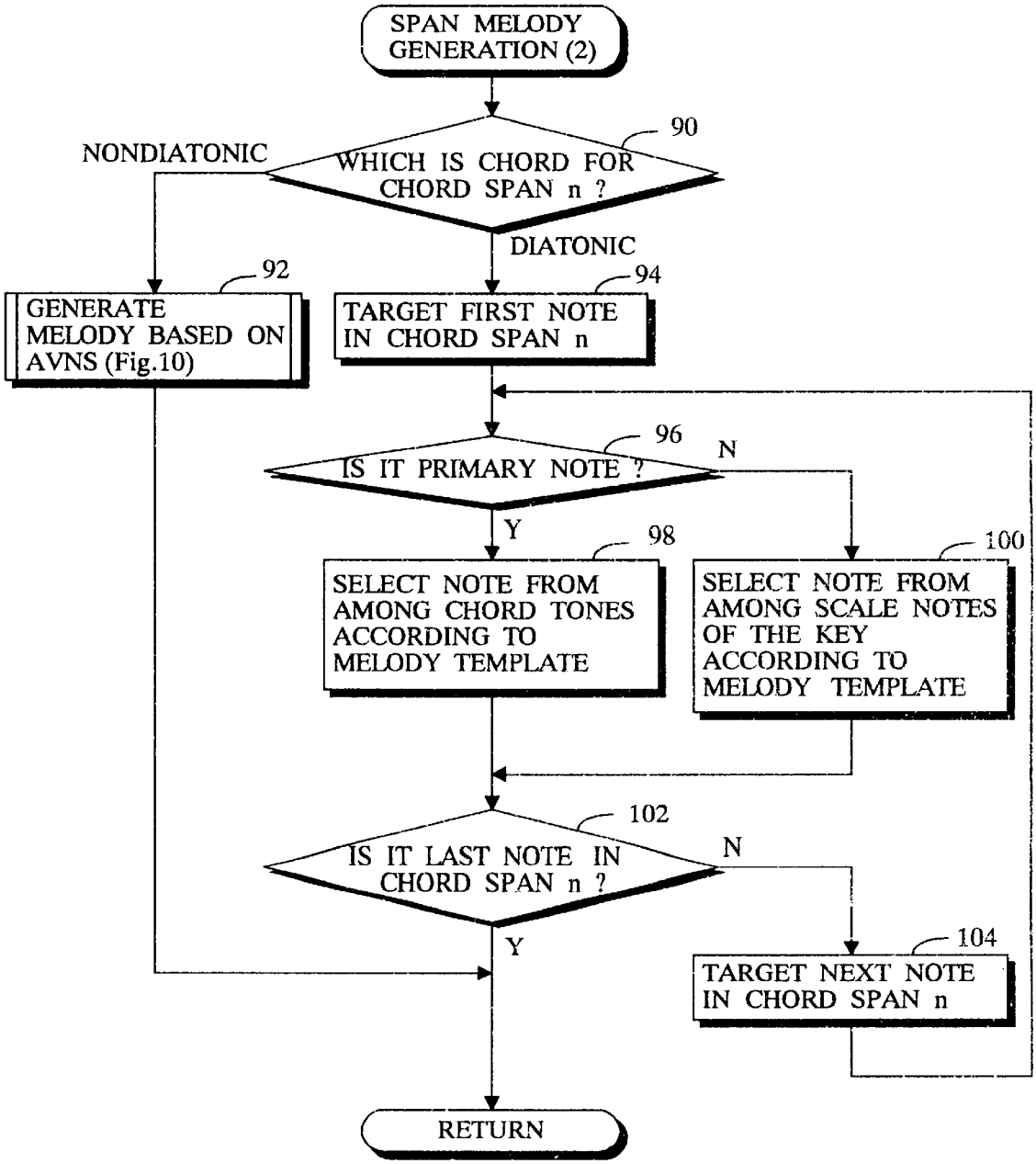
FIG. 11 is a flow chart of a subroutine showing a second example of the processing of span melody generation.

FIG. 11 shows a second example of the subroutine for generating span melodies as conducted at the step 58 of FIG. 9. A step 90 judges whether the chord designated for the chord span "n" is a diatonic chord or a nondiatonic chord. If the judgment proves that the chord is nondiatonic, the process moves to a step 92 in which melody generation processing takes place based on the AVNS as explained with reference to FIG. 10. If the judgment at the step 90 rules that the chord is diatonic, the process moves to a step 94 to target the first note of the chord span "n" as in the step 72 described above. Next, a step 96 judges whether the targeted note is a primary note or not like in the above step 74.

When the judgment answer at the step 96 is affirmative (Y), the note is a primary note and the process moves forward to a step 98. The step 98 selects a note from among the chord tones of this span according to the searched melody template in the memory area 16C. The selected note is employed as a melody note and the melody data representing the melody note is written into the memory area 16E.

When the judgment answer at the step 96 is negative (N), the note is a secondary note and the process moves forward to a step 100. The step 100 selects a note from among the scale notes of the designated key according to the searched melody template in the memory area 16C. The scale notes of the designated key are the notes constituting the musical scale of the key represented by the inputted key (tonality) data, and may be easily obtained by using a conversion table which converts the key data into the scale notes of the key. In selecting a note according to the searched melody template at the step 100, a note is determined so that the pitch change from the preceding note should be identical with or similar to the pitch change as indicated by the melody template. The selected note is employed as the melody note, and the data representing this melody note is written in the memory area 16E. When either of the steps 98 and 100 is over, the process goes to a step 102 to judge whether the target note is the last note in the chord span "n". When the process comes to the step 102 for the first time after the step 94 has targeted the first note in the chord span "n", and where the first note is not the last note in the span, the judgment at the step 102 turns out negative (N) and the process moves to a step 104.

The step 104 targets the next note in the chord span "n". Namely, the next note of the chord span "n" is referred to in the searched rhythm template in the memory area 16B. And then, the process goes back to the step 96 to repeat the steps 96–100 as described above. Thereafter, the processing through the steps 96–104 is repeated until the process at the step 98 or 100 is over with respect to the last note in the chord span "n". When the process at the step 98 or 100 is completed for the last note in the chord span "n", the step 102 judges affirmative (Y) and the process returns to the step 60 in FIG. 9. Also when the process at the step 92 is completed, the process returns to the step 60 in FIG. 9. At this time, the melody data representing the note pitches for all of the rhythm notes (notes in the rhythm pattern) as indicated by the rhythm template for the chord span "n" are stored in the memory area 16E.

According to the span melody generation processing of FIG. 11, the judgment is made as to whether the inputted chord is a diatonic chord or a nondiatonic chord and the melody notes are selected accordingly in such a manner that the notes in the scale of the inputted key are selected for the melody notes in the case of a diatonic chord while the notes in the determined AVNS are selected for the melody notes in the case of a nondiatonic chord. Thus, there is no necessity of obtaining available note scales with respect to diatonic chords which appear frequently in the usual tunes, which will lead to high speed processing.

Figure 12:
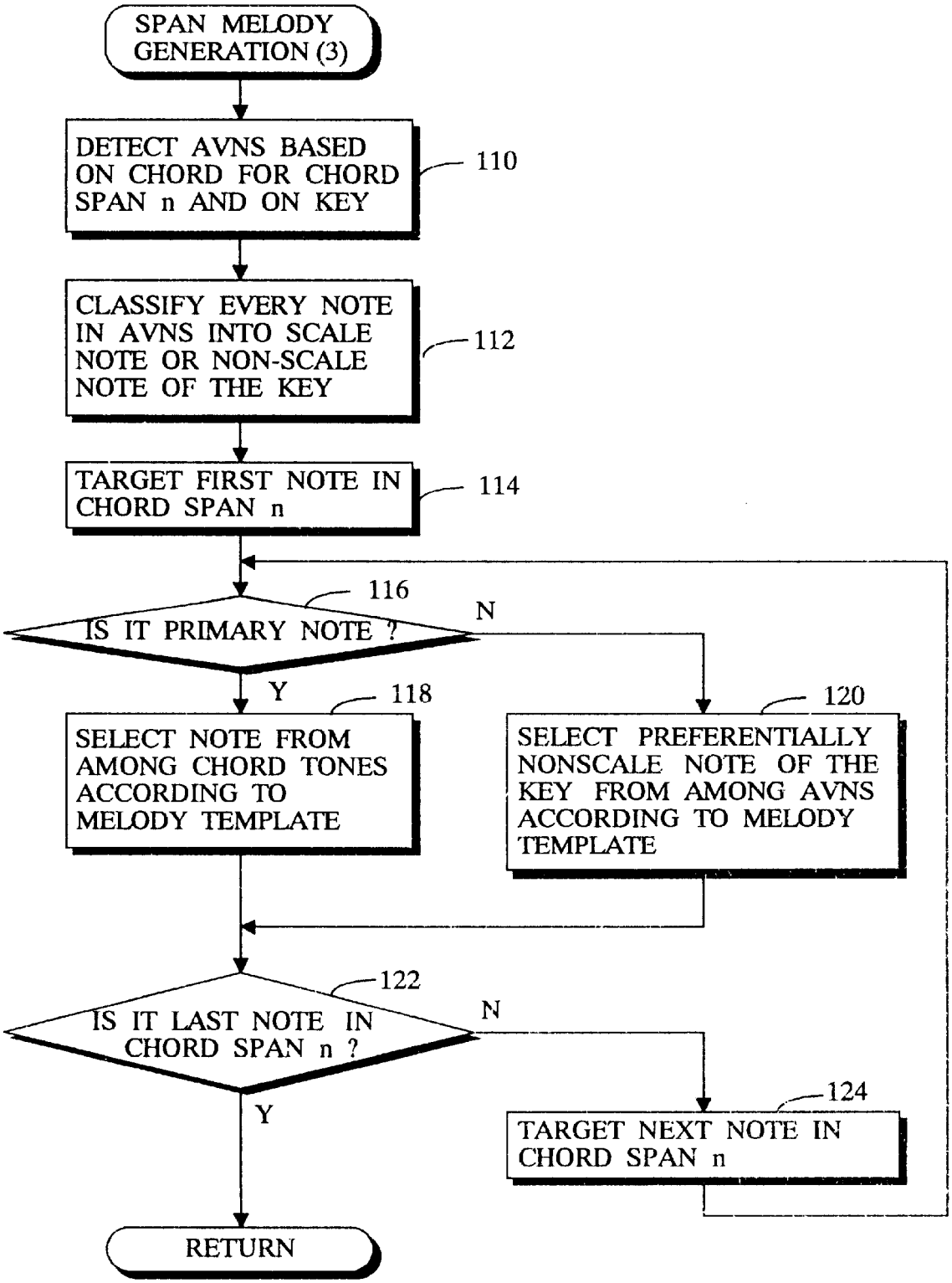
FIG. 12 is a flow chart of a subroutine showing a third example of the processing of span melody generation.

FIG. 12 shows a third example of the subroutine for generating span melodies as conducted at the step 58 of FIG. 9. A step 110 is to determine an available note scale based on the inputted key and on the inputted chord for the designated chord span "n" as in the step 70 above, and the data representing the notes constituting the determined available note scale is written in the memory area 16D. Then, the process moves to a step 112.

At the step 112, all of the notes in the available note scale (the notes represented by the data in the memory area 16D) are classified into two categories, the scale notes of the key and non-scale notes of the key. The scale notes here mean the notes which are included in the musical scale of the designated key, while the non-scale notes mean the notes which are not included in the musical scale of the key. For example, where the inputted key is the C major key and the detected AVNS is the Db Lydian scale, notes C, F and G in the AVNS are classified in the scale notes of the key and notes Db, Eb, Ab and Bb in the AVNS are classified in the non-scale notes of the key.

Next in the step 114, the first note in the designated chord span "n" is targeted as in the step 72 above. Then the process moves forward to a step 116 to judge whether the targeted note is a primary note as in the above described step 74.

Where the judgment answer at the step 116 is affirmative (Y), the targeted note is a primary note, and the process moves forward to a step 118. The step 118 is to select a note from among the chord tones according to the searched melody template in the memory area 16C as in the step 76. The selected notes are employed as melody notes, and the melody data representing the employed melody notes are written into the memory area 16E.

Where the judgment result at the step 116 is negative (N), the targeted note is a secondary note, and the process moves forward to a step 120. The step 120 selects preferentially a non-scale note (a note so classified at the step 112) of the designated key from among the AVNS constituting notes according to the searched melody template in the memory area 16C as done at the step 76. In the case of the example mentioned in connection with the step 112 above, one of the four notes Db, Eb, Ab and Bb which are the non-scale notes of the key of C is preferentially selected to the three notes C, F and G which are the scale notes of the key of C. A method for preferentially select a non-scale note may be:

(1) Every chord span should include at least one non-scale note.

(2) Greater weighting factors should be given to non-scale notes in the random selection of notes to increase the probability of the non-scale notes being selected.

(3) VVhen a scale note and a non-scale note are picked up as selection candidates, the non-scale note should be forcibly selected.

In selecting a note according to the searched melody template at the step 118 or 120, a note is determined so that the pitch change from the preceding note should be identical with or similar to the pitch change as indicated by the melody template. The selected note is employed as the melody note, and the data representing this melody note is written in the memory area 16E. When either of the steps 118 and 120 is over, the process goes to a step 122 to judge whether the target note is the last note in the chord span "n". When the process comes to the step 122 for the first time after the step 114 has targeted the first note in the chord span "n", and where the first note is not the last note in the span, the judgment at the step 122 turns out negative (N) and the process moves to a step 124.

The step 124 targets the next note in the chord span "n". Namely, the next note of the chord span "n" in the searched rhythm template in the memory area 16B is referred to for the processing. And then, the process goes back to the step 116 to repeat the steps 116–124 as described above. Thereafter, the processing through the steps 116–124 is repeated until the process at the step 118 or 120 is over with respect to the last note in the chord span "n". When the process at the step 118 or 120 is completed for the last note in the chord span "n", the step 122 judges affirmative (Y) and the process returns to the step 60 in FIG. 9. At this time, the melody data representing the note pitches for all of the rhythm notes (notes in the rhythm pattern) as indicated by the rhythm template for the chord span "n" are stored in the memory area 16E.

According to the span melody generation processing of FIG. 12, the notes in the available note scale are classified into scale notes and non-scale notes of the inputted key, and a note classified as a non-scale note is selected preferentially to a note classified as a scale note for a melody note. Thus, the generated melody will surely contain the non-scale notes of the key in the available note scale, and a characteristic nature of the nondiatonic chord will be enhanced.

Figure 13:
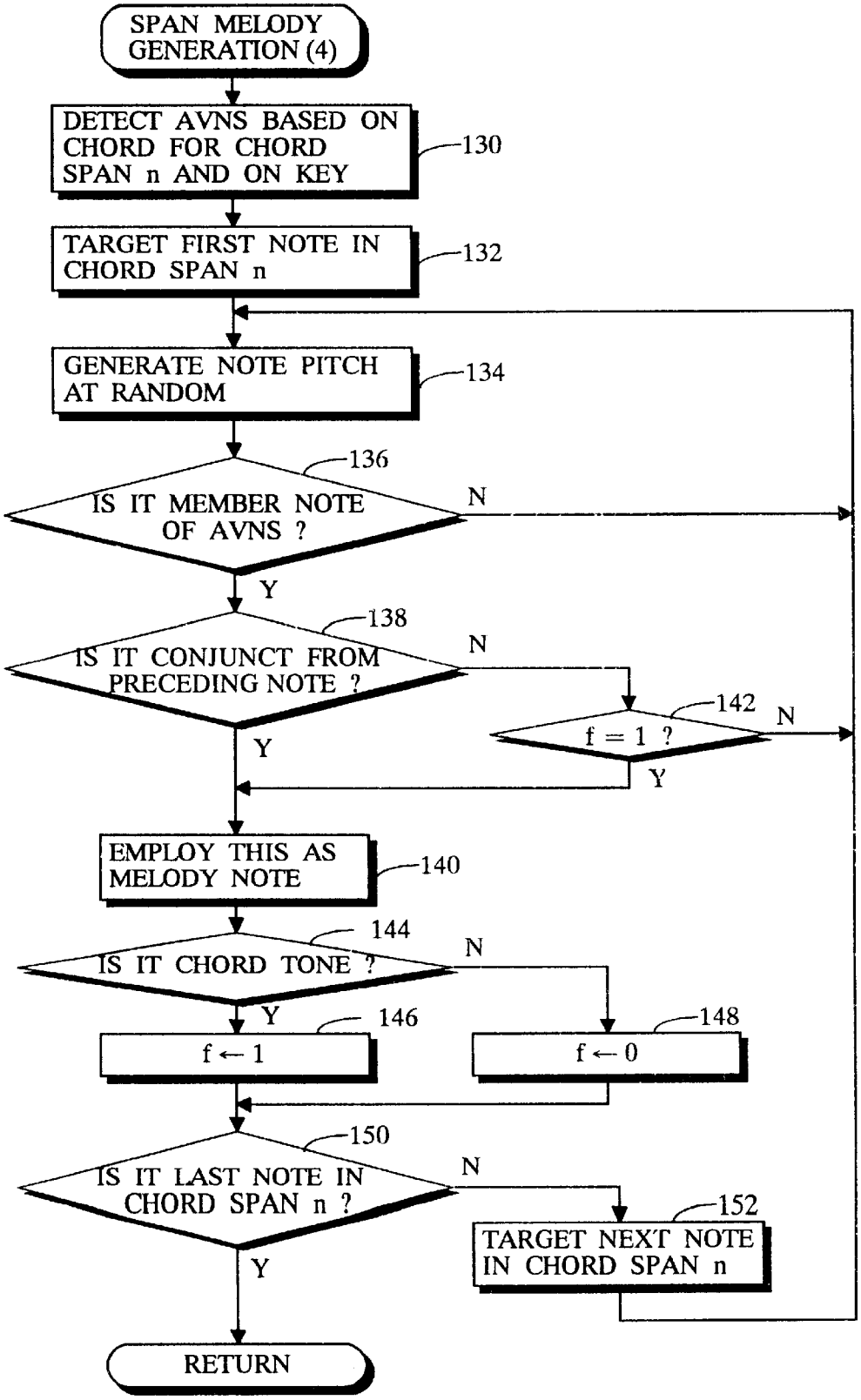
FIG. 13 is a flow chart of a subroutine showing a fourth example of the processing of span melody generation.

FIG. 13 shows a fourth example of the subroutine for generating span melodies as conducted at the step 58 of FIG. 9. In this case, the process of searching and selecting the melody template will be omitted at the step 52 and the process of classifying the rhythm notes into a primary note and a secondary note by the step 54 will also be omitted. A step 130 determines an available note scale based on the inputted key and on the inputted chord for the designated chord span "n" as in the step 70 above, and the data representing the notes constituting the determined available note scale is written in the memory area 16D. Then, the process moves to a step 132.

The step 132 targets the first note in the designated chord span "n" as the step 72 above does. Then the process moves forward to a step 134 to generate the data of any one of a number of different pitches at random. Next, a step 136 judges whether the note represented by the generated data is a member note in the available note scale. The member notes in the available note scale are represented by the data stored in the memory area 16D. When the judgment answer at the step 136 is negative (N), the process goes back to the step 134 to generate the data of a note at random. And again the step 136 judges whether the generated note is a member note of the available note scale.

Where the judgment answer at the step 136 is affirmative (Y), the generated note is a note contained in the available note scale, and the process moves forward to a step 138. The step 138 is to judge whether the note represented by the generated pitch data is conjunct (major second interval or less apart) from the preceding note. If this judgment rules affirmative (Y), the process moves forward to a step 140 to employ this generated note (data signal representing the note, and not an audible sound wave signal in this context) as a melody note. Where there is no preceding note such as in the case where the generated note is the first note of a tune, the step 138 is to be skipped so that the process goes directly to the step 140 to employ the generated note for a melody note.

When the judgment result at the step 138 is negative (N), this generated note is disjunct (minor third interval or more apart) from the preceding note, and the process moves to a step 142. The step 142 judges whether a chord tone flag "f" is "1" or not. Where the flag "1" is "1", it means that the preceding note is a chord tone (i.e. any of the member notes constituting the chord designated for the span "n"), and where the flag "f" is "0", it means that the preceding note is a nonchord tone (i.e. a note which is not included in the chord constituting notes). When the judgment answer at the step 142 is negative (N), the process goes back to the step 134 to generate a new note again through the steps 134–138. And if the newly generated note is judged to be conjunct from the preceding note at the step 138, this generated note is employed as a melody note at the step 140. When the judgment answer at the step 142 is affirmative (Y), the process goes forward to the step 140 to employ this generated note as a melody note. According to the above procedure, a wide jump in pitch will be permitted where the preceding note is a chord tone, whereas a wide jump will not be permitted where the preceding note is not a chord tone (another note should be generated to constitute a melody movement with successive degrees). When the randomly generated note is employed for a melody at the step 140, the melody data representing thus employed melody note is written in the storage subdivision 16E, before proceeding to a step 144.

The step 144 judges whether thus employed note is a chord tone or not. If the judgment answer is affirmative (Y), the process flows to a step 146 to set the flag "f" at "1", and if negative (N), a step 148 sets the flag "f" at "0". This procedure is a preparation for the judgment at the step 142 after the next note is selected at the step 136.

When either of the steps 146 and 148 is over, the process moves to a step 150 to judge whether the target note is the last note in the chord span "n". When the process comes to the step 150 for the first time after the step 132 has targeted the first note in the chord span "n", and where the first note is not the last note in the span, the judgment at the step 150 turns out negative (N) and the process moves to a step 152.

The step 152 targets the next note in the chord span "n". Namely, the next note of the chord span "n" in the searched rhythm template in the memory area 16B is referred to for the processing. And then, the process goes back to the step 134 to repeat the steps 134–150 as described above. Thereafter, the processing through the steps 134–152 is repeated until the process at the step 146 or 148 is over with respect to the last note in the chord span "n". When the process at the step 146 or 148 is completed for the last note in the chord span "n", the step 150 judges affirmative (Y) and the process returns to the step 60 in FIG. 9. At this time, the melody data representing the note pitches for all of the rhythm notes (notes in the rhythm pattern) as indicated by the rhythm template for the chord span "n" are stored in the memory area 16E.

Whereas the step 132 is provided to target (pick up or pay attention to) the first note in the rhythm template for the chord span "n", a target note for the processing may be decided by randomly setting the rhythm timing and the note duration to construct a randomly created rhythm pattern, rather than using a previously provided rhythm template. In randomly generating notes for a melody, there may be provided certain predetermined conditions such as limits on the note range and particular tendencies in pitch variation. Further, an alternative way of preventing a wide jump from a nonchord tone may be to detect wide jump positions from the preceding nonchord tones based on the constructed melody data and to modify such positions to narrow the jump, after the melody generation for each chord span is completed or after the melody generation of an entire tune is completed.

According to the span melody generation processing of FIG. 13, the notes are selected randomly from the available note scale determined for the chord span. Thus, a melody with full of variety can be easily generated.

Figure 14:
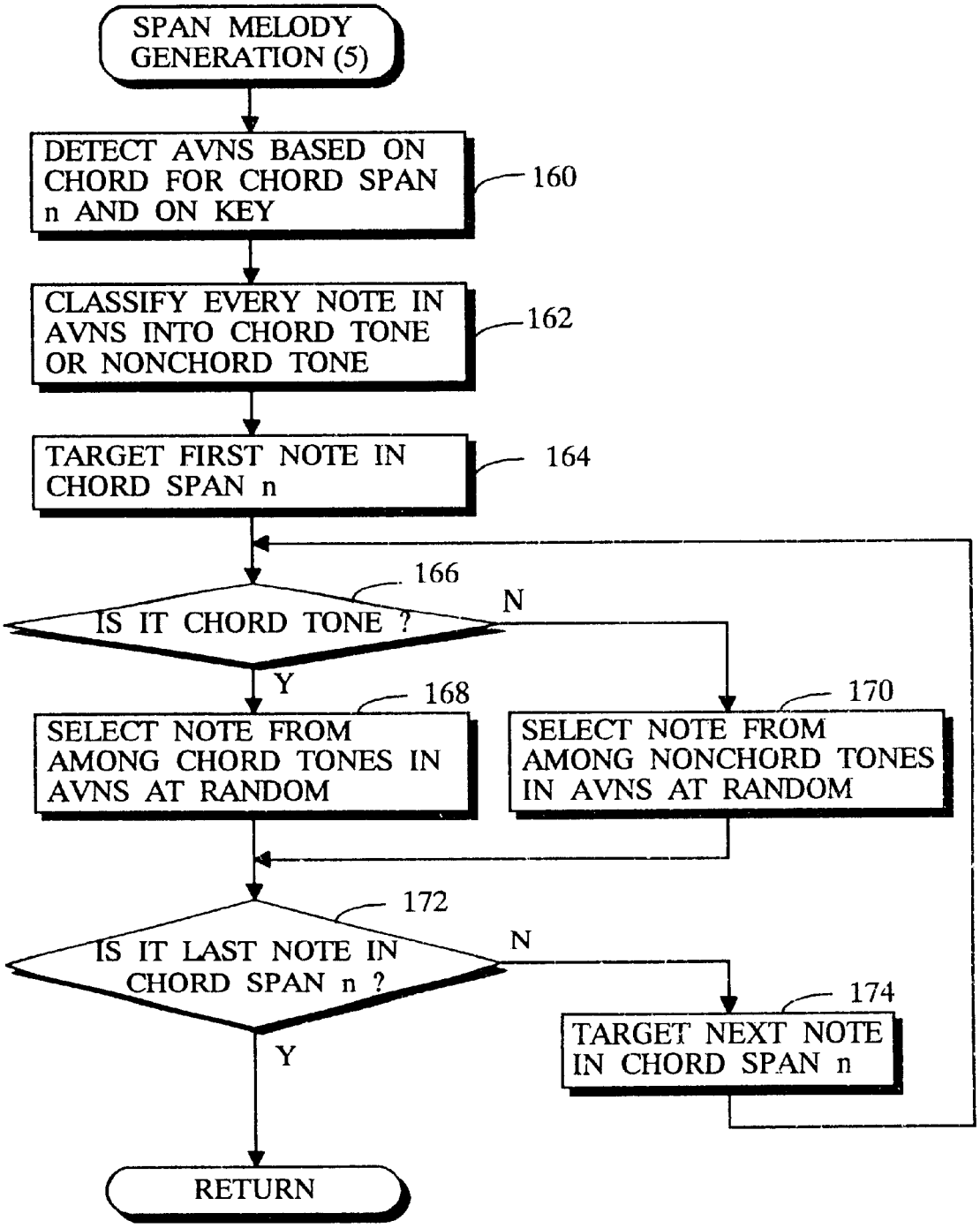
FIG. 14 is a flow chart of a subroutine showing a fifth example of the processing of span melody generation.
Figure 15:
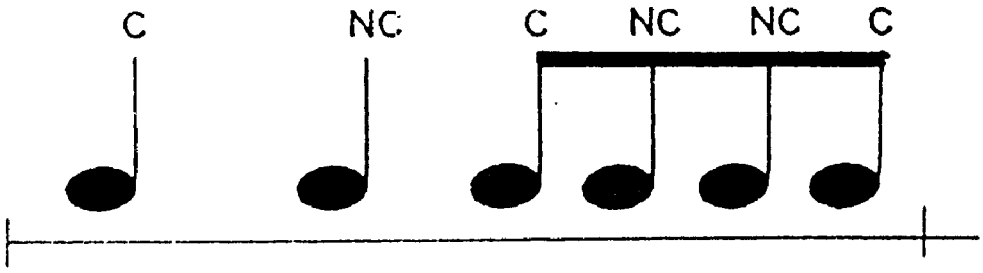
FIG. 15 is a chart showing a rhythm template including note category indications assigned to the notes.

FIG. 14 shows a fifth example of the subroutine for generating span melodies as conducted at the step 58 of FIG. 9. In this case, the process of searching and selecting the melody template will be omitted at the step 52 and the process of classifying the rhythm notes into a primary note and a secondary note by the step 54 will also be omitted. With respect to the rhythm templates to be searched and selected at the step 52, a note category indication is given to each rhythm note as shown in FIG. 15, in which "C" means a chord tone and "NC" means a nonchord tone. A step 160 determines an available note scale based on the inputted key and on the inputted chord for the designated chord span "n" as in the step 70 above, and the data representing the notes constituting the determined available note scale is written in the memory area 16D. Then, the process moves to a step 162.

At the step 162, all of the notes in the available note scale are classified into two categories, the chord tones of the designated chord for the chord span "n" and nonchord tones. The respective notes in the available note scale are represented by the data stored in the storage subdivision 16D. The chord tones are the notes which constitutes the chord designated for the chord span "n" under processing, while the nonchord tones are the notes other than the chord tones. For example, where the chord is DbM7 (D flat major seventh), notes Db, F, Ab and C are chord tones and notes Eb, G and Bb are nonchord tones. With respect to the notes classified as the chord tone, the mark data to indicate that they are chord tones are given and written in the memory area 16D. Then the process moves forward to a step 164.

Next in the step 164, the first note in the designated chord span "n" is targeted as in the step 72 above. Then the process moves forward to a step 166 to judge whether the targeted note is a chord tone. As the rhythm template includes a note category indication mark for each note of the rhythm pattern as described above, it will be easily detected whether the target note is a chord tone or not by simply referring to the note category indication data.

Where the judgment answer at the step 166 is affirmative (Y), the targeted note is a chord tone, and the process moves forward to a step 168. The step 168 is to select a note from among the chord tones in the available note scale at random. The chord tones in the available note scale are marked with chord tone mark data in the data stored in the storage area 16D and can be easily recognized. As to the above exemplified DbM7 chord, the step 168 randomly selects an arbitrary one from among the notes Db, F, Ab and C.

Where the judgment answer at the step 166 is negative (N), the targeted note is a nonchord tone, and the process moves forward to a step 170. The step 170 is to select a note from among the nonchord tones in the available note scale at random. The nonchord tones in the available note scale are the notes not marked with chord tone mark data in the data stored in the storage area 16D and can be easily recognized. As to the above exemplified DbM7 chord, the step 170 randomly selects an arbitrary one from among the notes Eb, G and Bb.

Both the step 168 and 170 employ the selected notes as melody notes, and the melody data representing the employed melody notes are written into the memory area 16E.

When either of the steps 168 and 170 is over, the process goes to a step 172 to judge whether the target note is the last note in the chord span "n". When the process comes to the step 172 for the first time after the step 164 has targeted the first note in the chord span "n", and where the first note is not the last note in the span, the judgment at the step 172 turns out negative (N) and the process moves to a step 174.

The step 174 targets the next note in the chord span "n". Namely, the next note of the chord span "n" in the searched rhythm template in the memory area 16B is referred to for the processing. And then, the process goes back to the step 166 to repeat the steps 166–172 as described above. Thereafter, the processing through the steps 166–174 is repeated until the process at the step 168 or 170 is over with respect to the last note in the chord span "n". When the process at the step 168 or 170 is completed for the last note in the chord span "n", the step 172 judges affirmative (Y) and the process returns to the step 60 in FIG. 9. At this time, the melody data representing the note pitches for all of the rhythm notes as indicated by the rhythm template for the chord span "n" are stored in the memory area 16E.

Alternatively in this embodiment, too, where the judgment result at the step 166 is negative (N), i.e. the target note is a nonchord tone, a judgment may be introduced as to whether the present note makes a wide jump from the preceding note such that a wide jump will be permitted only when the preceding note is a chord tone. In randomly generating notes for a melody, there may be provided certain predetermined conditions such as limits on the note range and particular tendencies in pitch variation. Further, with respect to the notes which are indicated to be nonchord tones, further indications about the nature of the note such as an appoggiatura, a passing note, a broderie and an escape tone may be included so that such notes will be selected from among nonchord tones in the available note scale.

According to the span melody generation processing of FIG. 14, the notes in the available note scale are classified into chord tones and nonchord tones and each rhythm note is assigned with a category indication of the chord tone or the nonchord tone, and for the note indicated to be a chord tone in the rhythm template, a melody note will be selected from the chord tones of the available note scale, while for the note indicated to be a nonchord tone in the rhythm template, a melody note will be selected from the nonchord tones of the available note scale. Thus the nonchord tones in the available note scale can be appropriately incorporated in the generated melody, and the characteristic nature of a nondiatonic chord will be enhanced.

Figure 16:
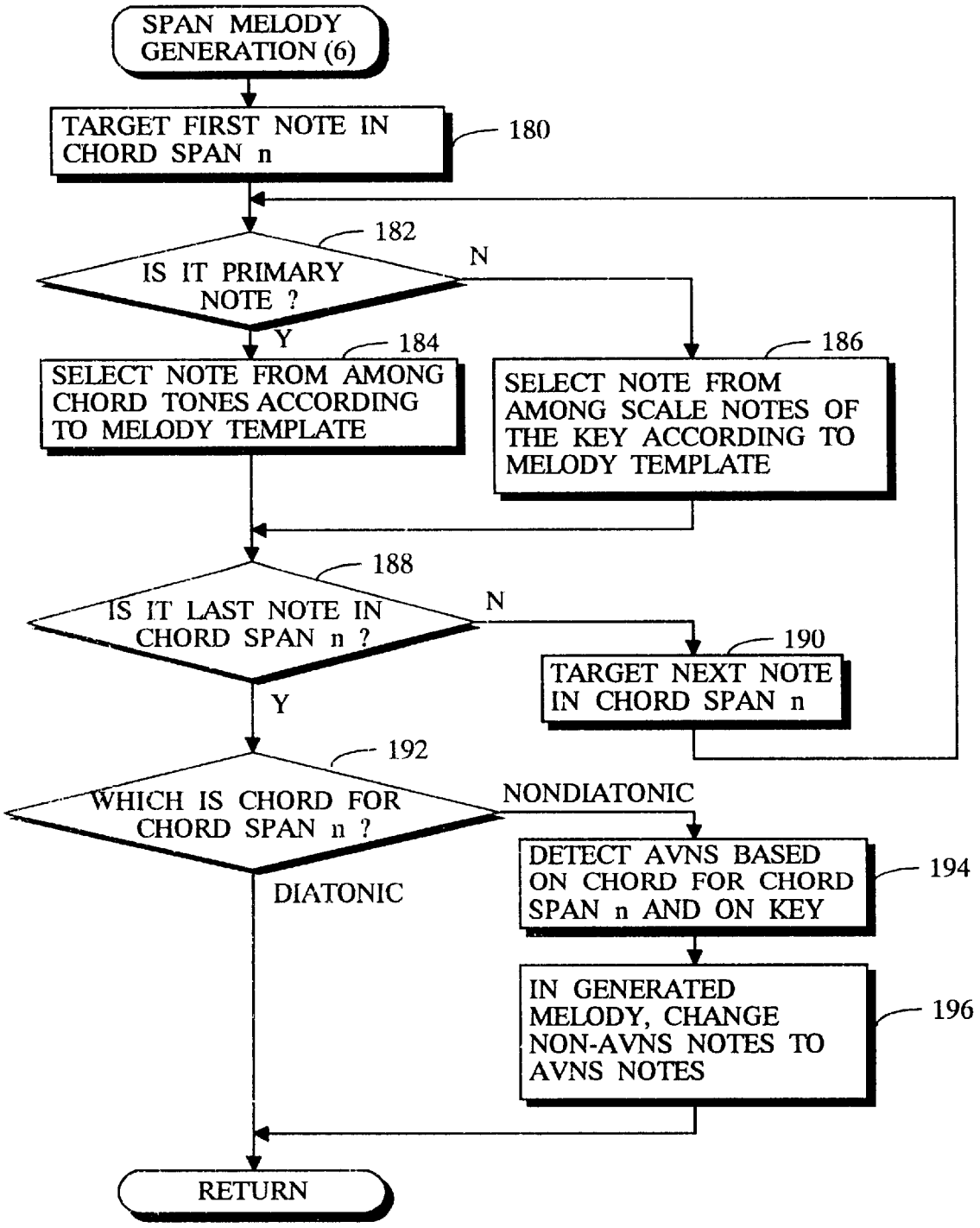
FIG. 16 is a flow chart of a subroutine showing a sixth example of the processing of span melody generation.

FIG. 16 shows a sixth example of the subroutine for generating span melodies as conducted at the step 58 of FIG. 9 above. A step 180 is to target the first note in the designated chord span "n" as in the step 72 described above. Then the process moves forward to a step 182. The step 182 judges whether the targeted note is a primary note as in the step 74 above.

Where the judgment result at the step 182 is affirmative (Y), the targeted note is a primary note, and the process moves forward to a step 184. The step 184 is to select a note from among the chord tones according to the searched melody template in the memory area 16C. The selected note is employed as the melody note, and the data representing this melody note is written in the memory area 16E.

Where the judgment result at the step 182 is negative (N), the targeted note is a secondary note, and the process moves forward to a step 186. The step 186 selects a note from among the scale notes of the designated key in accordance with the searched melody template in the memory area 16C. The scale notes of the key here are the notes which constitute the scale of the key indicated by the inputted key (tonality) data. For example, the scale notes are easily be obtained by using a conversion table to convert the key indicating data into scale constituting notes of the key.

In selecting a note according to the searched melody template at the step 184 or 186, a note is determined so that the pitch change from the preceding note should be identical with or similar to the pitch change as indicated by the melody template. The selected note is employed as the melody note, and the data representing this melody note is written in the memory area 16E. When the processing at either of the steps 184 and 186 is over, the process goes to a step 188 to judge whether the target note is the last note in the chord span "n". When the process comes to the step 188 for the first time after the step 180 has targeted the first note in the chord span "n", and where the first note is not the last note in the span, the judgment at the step 188 turns out negative (N) and the process moves to a step 190.

The step 190 targets the next note in the chord span "n". Namely, the next note of the chord span "n" is referred to in the searched rhythm template in the memory area 16B. And then, the process goes back to the step 182 to repeat the steps 182–188 as described before. Thereafter, the processing through the steps 182–190 is repeated until the process at the step 184 or 186 is over with respect to the last note in the chord span "n". When the process at the step 76 or 78 is completed for the last note in the chord span "n", the step 188 judges affirmative (Y) and the process moves forward to a step 192. At this time, the melody data representing the note pitches for all of the rhythm notes (notes in the rhythm pattern) as indicated by the rhythm template for the chord span "n" are stored in the memory area 16E.

The step 192 judges whether the chord for the chord span "n" is a diatonic chord or a nondiatonic chord. Where the judgment rules that it is a diatonic chord, the process goes back to the step 60 in FIG. 9. Where the judgment rules that it is a nondiatonic chord, the process goes forward to a step 194. The step 194 determines an available note scale based on the chord for the chord span "n" and on the key as in the step 70 before. The data representing the notes which constitutes the determined available note scale are written in the memory area 16D, before going to a step 196.

The step 196 is to change the notes in the generated melody which are note included in the available note scale into notes included in the available note scale. The generated melody here is represented by the data contained in the memory area 16E and the notes of the available note scale are represented by the data stored in the memory area 16D.

According to the span melody generation processing of FIG. 16, the chord tones of the inputted chord and the scale notes of the inputted key are selected for the melody notes, and the once generated melody notes are subjected to modification from the non-member notes of the available note scale to the member notes of the available note scale if the inputted chord for the chord span is nondiatonic, using a judgment step to check whether the inputted chord for the chord span "n" is diatonic or nondiatonic. In the case of a diatonic chord the selected note is employed as it is, while in the case of a nondiatonic chord the modified note is employed. Therefore, the example of this processing flow chart is constructed by simply adding the modification processing for the nondiatonic chord to the melody generation algorithm for the diatonic chord. Thus the generation algorithm for the diatonic chord can be economically utilized without changing specifically.

Although some specific examples of the present invention have been described above, this invention may not be limited to those examples but may be variously modified to perform the contemplated functions without departing from the spirit of the present invention. Examples of such a modification will be as follows.

(1) A processing of modifying the generated melody data according to the musical rules (grammar) may be incorporated after the processing of melody generation.

(2) The rhythm template and the melody template may be of any arbitrarily designed form. For example, a template may have only the pitches (in terms of data) of some unique points such as the very top and the very end of a musical tune, the top and the end of a musical sentence and the top and the tail of a phrase, and the in-between data are interpolated by using the notes in the available note scale (for instance, by picking up notes from the AVNS at random). The template may contain melodies for an entire tune or for a fraction of a tune and the melody may be modified to meet the AVNS. A motive melody may be inputted to the apparatus and the apparatus will generate a melody by developing such an inputted motive melody further.

(3) Melody note pitches may not necessarily be determined one after another consecutively from the top note for each chord span, but may be skippingly determined (selected from among the chord tones) for the primary notes in the targeted span, and the remaining secondary note may be determined by interpolating the in-between notes thereafter. Using this type of processing, passing notes, broderies, etc. may be employed for the melody notes from among the non-chord tones in the available note scale based on the musical rules (grammar).

(4) The generated melody data may be subjected to an arbitrary edition according to the user's instructions.

(5) The generated melody may be visually displayed or audibly presented to the user. When the generated melody is audibly presented by actual musical sound generation, the melody may be accompanied by an automatic accompaniment performance based on the inputted chord progression.

(6) The present invention may not be implemented in the form of an electronic musical instrument, but can be realized in the form of a combination of a personal computer and an application software. The application software may be supplied to the personal computer from any suitable storage media such as a magnetic disk, a magneto-optical disk and a semiconductor memory, or may supplied via a communication network.

(7) The present invention may be also applied for composing music accompaniment pieces in use for a karaoke apparatus (musical accompaniment apparatuses for singing songs), and may not be limited to electronic musical instruments.

(8) The present invention may not necessarily be limited to an electronic musical instrument of a keyboard type, but may also be applicable to an electronic musical instrument of a stringed instrument type, a wind instrument type, a percussion instrument type, etc.

(9) The present invention is applicable not only to an electronic musical instrument with a built-in tone generator device and a built-in automatic performance device, but to a combined musical system including a separate keyboard, a separate tone generator, a separate automatic performance device interconnected via a MIDI network or other various communication networks.

(10) The format of the performance data like the melody data and the chord data may be an "event+relative time" type in which each event is represented by the event identification and the relative time measured from the immediately preceding event, may be an "event+absolute time" type in which event is expressed by the event identification and the absolute time measured from the beginning of the tune or each measure, may be a "pitch+duration" type in which the music progression expressed by the pitch and the duration of each note and the duration of each rest, an "event mapping" type in which memory area is secured and allotted for all of a plurality of minimum time units and all the events are written at the respectively corresponding time positions in the memory area, and may be any other arbitrary type.

According to the present invention, an available note scale is determined based on the desired key and on the desired chords, and the melody notes are generated using the notes in such a determined available note scale. And therefore, not only the scale notes of the designated key, but also the non-scale notes of the designated key and the nonchord tones in the available note scale can be employed as the melody notes, which brings forth the merit of generating a melody having naturalness and fitting nondiatonic chords well. Further advantageous features will be as follows.

(1) As the notes are classified into primary notes and secondary notes, and the melody notes are selected from the inputted chord constituting notes for the primary notes and from the detected AVNS notes for the secondary notes, the generated melody will fit the chords well both in the case of diatonic chords and the case of nondiatonic chords, and will give a natural feeling as contrasted with diatonic chords and nondiatonic chords.

(2) As the judgment is made as to whether the inputted chord is a diatonic chord or a nondiatonic chord and the melody notes are selected accordingly in such a manner that the notes in the scale of the inputted key are selected for the melody notes in the case of a diatonic chord while the notes in the determined AVNS are selected for the melody notes in the case of a nondiatonic chord, there is no necessity of obtaining available note scales with respect to diatonic chords which appear frequently in the usual tunes, which will lead to high speed processing.

(3) As the notes in the available note scale are classified into scale notes and non-scale notes of the inputted key, and a note classified as a non-scale note is selected preferentially to a note classified as a scale note for a melody note, the generated melody will surely contain the non-scale notes of the key in the available note scale, and a characteristic nature of the nondiatonic chord will be enhanced.

(4) As the notes for the melody are selected randomly from the available note scale determined for the chord span, a melody with full of variety can be easily generated.

(5) As the notes in the available note scale are classified into chord tones and nonchord tones and each rhythm note is assigned with a category indication of the chord tone or the nonchord tone, and for the note indicated to be a chord tone in the rhythm template, a melody note will be selected from the chord tones of the available note scale, while for the note indicated to be a nonchord tone in the rhythm template, a melody note will be selected from the nonchord tones of the available note scale, the nonchord tones in the available note scale can be appropriately incorporated in the generated melody, and the characteristic nature of a nondiatonic chord will be enhanced.

(6) As the chord tones of the inputted chord and the scale notes of the inputted key are selected for the melody notes, and the once generated melody notes are subjected to modification from the non-member notes of the available note scale to the member notes of the available note scale if the inputted chord for the chord span is nondiatonic, using a judgment step to check whether the inputted chord for the chord span "n" is diatonic or nondiatonic, and in the case of a diatonic chord the selected note is employed as it is, while in the case of a nondiatonic chord the modified note is employed, the flow chart configuration is constructed by simply adding the modification processing for the nondiatonic chord to the melody generation algorithm for the diatonic chord. Thus the generation algorithm for the diatonic chord can be economically utilized without changing specifically.

While several forms of the invention have been shown and described, other forms will be apparent to those skilled in the art without departing from the spirit of the invention. Therefore, it will be understood that the embodiments shown in the drhawings and described above are merely for illustrative purposes, and are not intended to limit the scope of the invention, which is defined by the appended claims.

What is claimed is:

1. An apparatus for generating a melody comprising:

an input device which inputs key information designating a key and chord information designating chords for a melody to be generated;

a note set providing device which provides at least one first set of notes having pitches based on the inputted key information and the chord information and at least one second set of notes having pitches based on at least one of the inputted information and the chord information, said first set of notes being grouped from a first musical point of view and said second set of notes being grouped from a second musical point of view which is different from said first musical point of view;

a note targeting device which sequentially targets notes at time positions defining a rhythmic progression of the melody to be generated;

a note selecting device which selects for each targeted note a note having a pitch from among said first set of notes; and a melody constructing device which sequentially aligns said selected notes.

2. An apparatus as claimed in claim 1, wherein;

said note set providing device provides at least one available note scale as said first set of notes based on said inputted key information and said chord information, and provides chord tones which constitute the chord defined by said inputted chord information as said second set of notes;

said note targeting device includes a note category assigning device which classifies each of the notes to be targeted into two categories and assigns to each of the notes an indication of either a primary note or a secondary note; and said note selecting device selects a note from among said chord tones for the target note where said target note is a primary note, and selects a note from among the available note scale where said target note is a secondary note.

3. An apparatus as claimed in claim 1, wherein;

said note set providing device provides at least one available note scale as said first set of notes based on said inputted key information and said chord information, and provides scale notes which constitute the scale defined by said inputted key information as said second set of notes;

said note selecting device includes a chord category judging device which judges whether the chord defined by said inputted chord information is a diatonic chord or a nondiatonic chord; and said note selecting device selects a note from among said scale notes for the target note where said chord is a diatonic chord, and selects a note from among the available note scale where said chord is a nondiatonic chord.

4. An apparatus as claimed in claim 1, wherein;

said note set providing device provides at least one available note scale based on said inputted key information and said chord information, and provides a first set of notes consisting of those notes in said available note scale which are also the notes in the scale defined by said inputted key information and a second set of notes consisting of those notes in said available note scale which are not the notes in the scale defined by said inputted key information; and said note selecting device selects a note which belongs to said second set of notes preferentially to the notes which belong to said first set of notes.

5. An apparatus for generating a melody comprising:

an input device which inputs key information designating a key and chord information designating chords for a melody to be generated;

an available note scale providing device which provides available note scales based on the inputted key information and the chord information;

a note targeting device which sequentially targets notes to be aligned in a melody;

a note selecting device which selects for each targeted note a note from among the provided available note scale at random; and a melody constructing device which sequentially aligns said selected notes.

6. An apparatus as claimed in claim 1, wherein;

said note set providing device provides at least one available note scale based on said inputted key information and said chord information, and provides a first set of notes consisting of those notes in said available note scale which are the notes included in the designated chord and a second set of notes consisting of those notes in said available note scale which are the notes not included in the designated chord;

said note targeting device includes a note category assigning device which classifies each of the notes to be targeted into two categories and assigns to each of the notes an indication of either a chord tone or a nonchord tone; and said note selecting device selects a note which belongs to said first set of notes where the target note is assigned with the chord tone indication, and selects a note which belongs to said second set of notes where the target note is assigned with the nonchord tone indication.

7. An apparatus for generating a melody comprising:

an input device which inputs key information designating a key and chord information designating chords in progression for a melody to be generated;

a first note set providing device which provides a first set of note pitches constituting a scale of the key designated by said inputted key information;

a second note set providing device which provides a second set of note pitches constituting an available note scale as determined based on said inputted key information and the chord information;

a note targeting device which sequentially targets notes at time positions defining a rhythmic progression of the melody to be generated;

a note selecting device which selects for each targeted note a note pitch from among said first set of note pitches;

a chord judging device which judges each of the designated chords as to whether said each chord is a diatonic chord or a nondiatonic chord;

a note delivering device which delivers said note pitch selected by said note selecting device where the chord is judged as a diatonic chord by said chord judging device, and delivers said note pitch selected by said note selecting device if it is the one included in said second set of note pitches but changes said note pitch selected by said note selecting device if it is not the one included in said second set of note pitches into a note pitch in said second set of note pitches and delivers the changed note pitch where the chord is judged as a nondiatonic chord by said chord judging device; and a melody constructing device which sequentially aligns said delivered notes.

8. A method for generating a melody comprising the steps of:

inputting key information which designates a key and chord information which designates chords for a melody to be generated;

providing at least one first set of note pitches based on the inputted key information and the chord information and at least one second set of note pitches based on at least one of the inputted information and the chord information, said first set of note pitches being grouped from a first musical point of view and said second set of note pitches being grouped from a second musical point of view which is different from said first musical point of view;

targeting a note at a time position among a succession of time positions defining a rhythmic progression of the melody to be generated, said step of targeting occurring in a sequence;

selecting for each targeted note a note pitch from among said first set of notes; and aligning said selected note pitches in said sequence.

9. A method as claimed in claim 8, further comprising a step of:

assigning to each of said notes to be targeted an indication of either a primary note or a secondary note; and wherein;

said step of providing sets of note pitches provides at least one available note scale as said first set of note pitches based on said inputted key information and said chord information, and provides chord tones which constitute the chord defined by said inputted chord information as said second set of note pitches; and said step of selecting a note pitch selects a note from among said chord tones for the target note where said target note is a primary note, and selects a note from among the available note scale where said target note is a secondary note.

10. A method as claimed in claim 8, further comprising a step of:

judging whether the chord defined by said inputted chord information is a diatonic chord or a nondiatonic chord; and wherein;

said step of providing sets of note pitches provides at least one available note scale as said first set of note pitches based on said inputted key information and said chord information, and provides note pitches which constitute the scale defined by said inputted key information as said second set of note pitches; and said step of selecting a note pitch selects a note pitch from among said second set of note pitches for the target note where said chord is a diatonic chord, and selects a note pitch from among said first set of note pitches for the target note where said chord is a nondiatonic chord.

11. A method as claimed in claim 8, wherein;

said step of providing sets of note pitches provides at least one available note scale based on said inputted key information and said chord information, and provides a first set of notes consisting of those notes in said available note scale which are also the notes in the scale defined by said inputted key information and a second set of notes consisting of those notes in said available note scale which are not the notes in the scale defined by said inputted key information; and said step of selecting a note pitch selects a note which belongs to said second set of notes preferentially to the notes which belong to said first set of notes.

12. A method for generating a melody comprising the steps of:

inputting key information which designates a key and chord information which designates chords for a melody to be generated;

providing available note scales based on the inputted key information and the chord information;

targeting a note at a time position among a succession of time positions defining a rhythmic progression of the melody to be generated, said step of targeting occurring in a sequence;

selecting for each targeted note a note pitch from among the provided available note scale at random; and aligning said selected note pitches in said sequence.

13. A method as claimed in claim 8, further comprising a step of:

assigning to each of said notes to be targeted an indication of either a chord tone or a nonchord tone; and wherein;

said step of providing sets of note pitches provides at least one available note scale based on said inputted key information and said chord information, and provides a first set of note pitches consisting of those in said available note scale which are the note pitches included in the designated chord and a second set of note pitches consisting of those in said available note scale which are the note pitches not included in the designated chord; and said step of selecting a note pitch selects a note pitch which belongs to said first set of note pitches where the target note is assigned with the chord tone indication, and selects a note pitch which belongs to said second set of note pitches where the target note is assigned with the nonchord tone indication.

14. A method for generating a melody comprising the steps of:

inputting key information which designates a key and chord information which designates chords in progression for a melody to be generated;

providing a first set of note pitches constituting a scale of the key designated by said inputted key information;

providing a second set of note pitches constituting an available note scale as determined based on said inputted key information and the chord information;

targeting a note at a time position among a succession of time positions defining a rhythmic progression of the melody to be generated, said step of targeting occurring in a sequence;

selecting for each targeted note a note pitch from among said first set of note pitches;

judging each of the designated chords as to whether said each chord is a diatonic chord or a nondiatonic chord;

delivering said note pitch selected by said step of selecting a note pitch from among said first set of note pitches where the chord is judged as a diatonic chord by said step of judging a chord;

delivering said note pitch selected by said step of selecting a note pitch from among said first set of note pitches if the selected note pitch is the one included in said second set of note pitches but changing said note pitch selected by said step of selecting a note pitch from among said first set of note pitches if the selected pitch is not the one included in said second set of note pitches into a note pitch in said second set of note pitches and delivering the changed note pitch where the chord is judged as a nondiatonic chord by said step of judging a chord; and aligning said delivered note pitches in said sequence.

15. A machine readable medium for use in an apparatus for generating a melody, said apparatus being of a data processing type comprising a computer, said medium containing program instructions executable by said computer for executing:

a process of inputting key information which designates a key and chord information which designates chords for a melody to be generated;

a process of providing at least one first set of note pitches based on the inputted key information and the chord information and at least one second set of note pitches based on at least one of the inputted information and the chord information, said first set of note pitches being grouped from a first musical point of view and said second set of note pitches being grouped from a second musical point of view which is different from said first musical point of view;

a process of targeting a note at a time position among a succession of time positions defining a rhythmic progression of the melody to be generated, said step of targeting occurring in a sequence;

a process of selecting for each targeted note a note pitch from among said first set of notes; and a process of aligning said selected note pitches in said sequence.

16. A machine readable medium as claimed in claim 15 further containing program instructions for executing:

a process of assigning to each of said notes to be targeted an indication of either a primary note or a secondary note; and wherein;

said process of providing sets of note pitches provides at least one available note scale as said first set of note pitches based on said inputted key information and said chord information, and provides chord tones which constitute the chord defined by said inputted chord information as said second set of note pitches; and said process of selecting a note pitch selects a note from among said chord tones for the target note where said target note is a primary note, and selects a note from among the available note scale where said target note is a secondary note.

17. A machine readable medium as claimed in claim 15 further containing program instructions for executing:

a process of judging whether the chord defined by said inputted chord information is a diatonic chord or a nondiatonic chord; and wherein;

said process of providing sets of note pitches provides at least one available note scale as said first set of note pitches based on said inputted key information and said chord information, and provides note pitches which constitute the scale defined by said inputted key information as said second set of note pitches; and said process of selecting a note pitch selects a note pitch from among said second set of note pitches for the target note where said chord is a diatonic chord, and selects a note pitch from among said first set of note pitches for the target note where said chord is a nondiatonic chord.

18. A machine readable medium as claimed in claim 15, wherein said process of providing sets of note pitches provides at least one available note scale based on said inputted key information and said chord information, and provides a first set of notes consisting of those notes in said available note scale which are also the notes in the scale defined by said inputted key information and a second set of notes consisting of those notes in said available note scale which are not the notes in the scale defined by said inputted key information; and said process of selecting a note pitch selects a note which belongs to said second set of notes preferentially to the notes which belong to said first set of notes.

19. A machine readable medium for use in an apparatus for generating a melody, said apparatus being of a data processing type comprising a computer, said medium containing program instructions executable by said computer for executing:

a process of inputting key information which designates a key and chord information which designates chords for a melody to be generated;

a process of providing available note scales based on the inputted key information and the chord information;

a process of targeting a note at a time position among a succession of time positions defining a rhythmic progression of the melody to be generated, said process of targeting occurring in a sequence;

a process of selecting for each targeted note a note pitch from among the provided available note scale at random; and a process of aligning said selected note pitches in said sequence.

20. A machine readable medium as claimed in claim 15 further containing program instructions for executing:

a process of assigning to each of said notes to be targeted an indication of either a chord tone or a nonchord tone; and wherein;

said process of providing sets of note pitches provides at least one available note scale based on said inputted key information and said chord information, and provides a first set of note pitches consisting of those in said available note scale which are the note pitches included in the designated chord and a second set of note pitches consisting of those in said available note scale which are the note pitches not included in the designated chord; and said process of selecting a note pitch selects a note pitch which belongs to said first set of note pitches where the target note is assigned with the chord tone indication, and selects a note pitch which belongs to said second set of note pitches where the target note is assigned with the nonchord tone indication.

21. A machine readable medium for use in an apparatus for generating a melody, said apparatus being of a data processing type comprising a computer, said medium containing program instructions executable by said computer for executing:

a process of inputting key information which designates a key and chord information which designates chords in progression for a melody to be generated;

a process of providing a first set of note pitches constituting a scale of the key designated by said inputted key information;

a process of providing a second set of note pitches constituting an available note scale as determined based on said inputted key information and the chord information;

a process of targeting a note at a time position among a succession of time positions defining a rhythmic progression of the melody to be generated, said process of targeting occurring in a sequence;

a process of selecting for each targeted note a note pitch from among said first set of note pitches;

a process of judging each of the designated chords as to whether said each chord is a diatonic chord or a nondiatonic chord;

a process of delivering said note pitch selected by said process of selecting a note pitch from among said first set of note pitches where the chord is judged as a diatonic chord by said process of judging a chord;

a process of delivering said note pitch selected by said process of selecting a note pitch from among said first set of note pitches if the selected note pitch is the one included in said second set of note pitches but changing said note pitch selected by said process of selecting a note pitch from among said first set of note pitches if the selected pitch is not the one included in said second set of note pitches into a note pitch in said second set of note pitches and delivering the changed note pitch where the chord is judged as a nondiatonic chord by said process of judging a chord; and a process of aligning said delivered note pitches in said sequence.

22. An apparatus for generating a melody comprising:

an input means for inputting key information designating a key and chord information designating chords for a melody to be generated;

a note set providing means for providing at least one available note scale based on said inputted key information and said chord information, and providing chord tones which constitute the chord defined by said inputted chord information;

a note targeting means for sequentially targeting notes at time positions defining a rhythmic progression of the melody to be generated;

a note category assigning means for classifying each of the notes to be targeted into two categories by assigning to each of the notes an indication of either a primary note or a secondary note;

a note selecting means for selecting for each targeted note a note from among said chord tones where said target note is a primary note, and selecting for each targeted note a note from among the available note scale where said target note is a secondary note; and a melody constructing means for sequentially aligning said selected notes.

23. An apparatus for generating a melody comprising:

an input means for inputting key information designating a key and chord information designating chords for a melody to be generated;

a note set providing means for providing at least one available note scale based on said inputted key information and said chord information, and providing scale notes which constitute the scale defined by said inputted key information;

a note targeting means for sequentially targeting notes at time positions defining a rhythmic progression of the melody to be generated;

a note selecting means for selecting for each targeted note a note from among said scale notes for the target note where said chord is a diatonic chord, and selecting for each targeted note a note from among the available note scale where said chord is a nondiatonic chord; and a melody constructing means for sequentially aligning said selected notes.

24. An apparatus for generating a melody comprising:

an input means for inputting key information designating a key and chord information designating chords for a melody to be generated;

a note set providing means for providing at least one available note scale based on said inputted key information and said chord information, said available note scale consisting of a first set of note pitches and a second set of note pitches, said first set of note pitches being notes included in the designated chord and said second set of note pitches being notes not included in the designated chord;

a note targeting means for sequentially targeting notes at time positions defining a rhythmic progression of the melody to be generated;

a note category assigning means for classifying each of the notes to be targeted into two categories by assigning to each of the notes an indication of either a chord tone or a nonchord tone;

a note selecting means for selecting for each targeted note a note which belongs to said first set of notes where the target note is assigned with the chord tone indication, and selecting a note which belongs to said second set of notes where the target note is assigned with the nonchord tone indication; and a melody constructing means for sequentially aligning said selected notes.

* * * * *